US009404199B2

(12) United States Patent
Tanaka et al.

(10) Patent No.: US 9,404,199 B2
(45) Date of Patent: Aug. 2, 2016

(54) POLYURETHANE ELASTIC YARN AND METHOD FOR PRODUCING SAME

(75) Inventors: Toshihiro Tanaka, Shiga (JP); Masashi Hara, Shiga (JP)

(73) Assignee: INVISTA North America S.a.r.l., Wilmington, DE (US)

( * ) Notice: Subject to any disclaimer, the term of this patent is extended or adjusted under 35 U.S.C. 154(b) by 0 days.

(21) Appl. No.: 13/515,949

(22) PCT Filed: Dec. 16, 2010

(86) PCT No.: PCT/JP2010/072609

§ 371 (c)(1), (2), (4) Date: Jun. 14, 2012

(87) PCT Pub. No.: WO2011/074622

PCT Pub. Date: Jun. 23, 2011

(65) Prior Publication Data

US 2012/0296016 A1 Nov. 22, 2012

(30) Foreign Application Priority Data

Dec. 16, 2009 (JP) ..... 2009-285108

(51) Int. Cl.

| | |
|---|---|
| ***C08L 75/04*** | (2006.01) |
| ***C08K 5/3475*** | (2006.01) |
| ***D01F 1/10*** | (2006.01) |
| ***D01F 6/70*** | (2006.01) |

(52) U.S. Cl.
CPC . *D01F 1/106* (2013.01); *D01F 6/70* (2013.01)

(58) Field of Classification Search
None
See application file for complete search history.

(56) References Cited

U.S. PATENT DOCUMENTS

| | | | | |
|---|---|---|---|---|
| 3,386,942 | A * | 6/1968 | Kibler et al. | 524/130 |
| 3,642,669 | A * | 2/1972 | Nast et al. | 521/170 |
| 4,127,586 | A * | 11/1978 | Rody et al. | 548/260 |
| 5,264,526 | A | 11/1993 | Kashiwai et al. | |
| 5,518,818 | A * | 5/1996 | Kidai et al. | 428/412 |
| 6,207,077 | B1 * | 3/2001 | Burnell-Jones | 252/301.36 |
| 6,312,802 | B1 * | 11/2001 | Nishida et al. | 428/357 |
| 2006/0210794 | A1 * | 9/2006 | Hutte | 428/364 |

FOREIGN PATENT DOCUMENTS

| | | | |
|---|---|---|---|
| JP | 2000-63662 | A | 2/2000 |
| JP | 2000-169700 | A | 6/2000 |
| JP | 2001-81310 | A | 3/2001 |
| JP | 2002-371433 | A | 12/2002 |
| JP | 2006-193867 | A | 7/2006 |
| JP | 2006-307351 | A | 9/2006 |

OTHER PUBLICATIONS

International Search Report corresponding to PCT/JP2010/072609 mailed Mar. 1, 2011.

First Office Action issued to Chinese Patent Application 201080064022.4 on Sep. 13, 2013.

Translation of First Office Action issued to Chinese Patent Application 201080064022.4.

Text of First Office Action issued to Chinese Patent Application 201080064022.4.

Translation of Search Report issued to Chinese Patent Application 201080064022.4.

* cited by examiner

*Primary Examiner* — Jeffrey Washville
(74) *Attorney, Agent, or Firm* — Bridget C. Sciamanna

(57) ABSTRACT

Problem

To provide a polyurethane elastic yarn with excellent elongation, recoverability, and light resistance that is suitable for use in stretchable fabrics and clothing, and to provide a method for manufacture thereof.

Resolution Means

Include a benzotriazole ultraviolet absorber containing one or more unsaturated bond in the molecule when manufacturing elastic yarn made of polyurethane with a polymeric diol and diisocyanate as starting material.

20 Claims, No Drawings

POLYURETHANE ELASTIC YARN AND METHOD FOR PRODUCING SAME

CROSS REFERENCE TO RELATED APPLICATIONS

This application is a 371 of PCT/JP2010/072609, filed Dec. 16, 2010, which claims benefit of priority from Japanese Application No. 2009-285108, filed Dec. 16, 2009; both of which are incorporated by reference in their entirety.

TECHNICAL FIELD

The present invention relates to polyurethane elastic yarn and a method for producing the same.

BACKGROUND ART

Due to their excellent stretch characteristics, elastic fibers are widely used in industrial materials applications and stretch apparel applications such as legwear, underwear and sportswear.

Among such elastic fibers, polyurethane elastic fibers have been used in a particularly wide diversity of applications, but polyurethane elastic yarn has the drawbacks that it is easily degraded and discolored by light. For this reason, when stretch fabric products are displayed in stores, worn as clothing or washed and then dried outdoors and so forth, the polyurethane elastic yarn that was used gradually becomes brittle due to light.

Incidentally, to prevent the polyurethane elastic yarn from becoming brittle due to light, there is known art for producing polyurethane elastic fiber by spinning a spinning starting solution containing polyurethane supplemented with various ultraviolet light absorbents (Patent References 1, 2). Furthermore, there is known art for copolymerizing specified ultraviolet light absorbents with polyurethane in order to maintain excellent resistance to light and to prevent loss of the ultraviolet light absorbents due to abrasion, heat treatment and dying in the high-level processing steps or due to washing and dry cleaning after being made into a fabric product (Patent Reference 3).

These techniques, however, all have the objective of preventing degradation by light, and due to the addition of ultraviolet light absorbents, the fracture strength and elongation characteristics and recovery characteristics of the polyurethane elastic yarn immediately after spinning end up being the same as or, depending on the case, worse than those of polyurethane elastic yarn in which no ultraviolet light absorbents were added.

PRIOR ART REFERENCES

Patent References

Patent Reference 1: JP-A-2000-169700
Patent Reference 1: JP-A-2001-81310
Patent Reference 1: JP-A-2006-307351

SUMMARY OF THE INVENTION

Problems the Invention is to Solve

The present invention has an objective of providing polyurethane elastic yarn and a method for producing the same by which strength and elongation characteristics (fracture strength, fracture elongation) and recovery characteristics are improved and loss of ultraviolet light absorbents due to post-treatment during high-level processing and washing is reduced by the addition of specified ultraviolet light absorbents. A further objective of the present invention is to provide polyurethane elastic yarn and a method for producing the same by which the stress when strain is applied to the region of actual use (called 11Strength in region of actual use" hereinafter) can be increased.

Means for Solving Problems

The polyurethane elastic yarn of the present invention employs any of the following means to achieve the aforementioned objectives.

(1) Polyurethane elastic yarn made up of polyurethane having polymer diol and diisocyanate as starting substances, comprising at least one among (A), (B) and (C) below:
  (A) a benzotriazole-based ultraviolet light absorbent and/or benzophenone-based ultraviolet light absorbent containing at least one unsaturated bond in the molecule,
  (B) a benzotriazole-based ultraviolet light absorbent containing at least one alkoxy group in the molecule,
  (C) a benzophenone-based ultraviolet light absorbent containing at least one sulfonic acid group in the molecule.

(2) The polyurethane elastic yarn according to item (1) comprising said (A), wherein said (A) is a copolymer of an unsaturated carboxylic acid-based compound and a compound having a benzotriazole skeleton and/or a compound having a benzophenone skeleton.

(3) The polyurethane elastic yarn according to item (1) or (2) comprising said (A), wherein said (A) is a copolymer of a compound containing a methacrylic acid skeleton and a compound having a benzotriazole skeleton and/or a compound having a benzophenone skeleton.

(4) The polyurethane elastic yarn according to item (1) comprising said (B), wherein the alkoxy group of said (B) has from 1 to 40 carbons.

(5) The polyurethane elastic yarn according to item (4), wherein the alkoxy group of said (B) has from 6 to 20 carbons.

(6) The polyurethane elastic yarn according to item (1) comprising said (C), wherein said (C) contains an alkoxy group.

(7) A method for producing polyurethane elastic yarn characterized in that at least one among (A), (B) and (C) below is included in a spinning starting solution containing polyurethane having polymer diol and diisocyanate as starting substances:
  (A) a benzotriazole-based ultraviolet light absorbent and/or benzophenone-based ultraviolet light absorbent containing at least one unsaturated bond in the molecule,
  (B) a benzotriazole-based ultraviolet light absorbent containing at least one alkoxy group in the molecule,
  (C) a benzophenone-based ultraviolet light absorbent containing at least one sulfonic acid group in the molecule.

Advantageous Effect of the Invention

Due to the addition of specified ultraviolet light absorbents, the polyurethane elastic yarn of the present invention has higher strength and elongation and higher recovery characteristics as well as better resistance to light than those in which no ultraviolet light absorbents were added and those that contain other ultraviolet light absorbents. Furthermore, loss of ultraviolet light absorbents due to washing and post-treatment during high-level processing is reduced while maintaining excellent resistance to light. Additionally, it is possible to increase strength in regions of actual use. For these reasons, apparel and so forth that uses such elastic yarn is easy to put on and take off and has excellent fit, feel, discoloration characteristics and quality of appearance, and can be made into thin fabric, thereby reducing weight.

BEST MODE FOR CARRYING OUT THE INVENTION

The polyurethane in the present invention may be any without particular limitation provided that it has starting substances of polymer dial and diisocyanate. Furthermore, the method of synthesis thereof is not particularly limited.

For example, it may be polyurethane urea made up of a polymer dial and diisocyanate and low-molecular-weight diamine, or polyurethane made up of a polymer dial and diisocyanate and low-molecular-weight dial. Furthermore, it may be polyurethane urea that uses a compound having a hydroxyl group and amino group in the molecule as a chain extender. Note that it is preferred that a polyfunctional glycol or isocyanate or the like that is trifunctional or above is used within a range that does not hinder the advantageous effects of the present invention.

Typical structural units that constitute the polyurethane in the present invention will be described below.

The preferred polymer dials of the structural units that constitute the polyurethane are polyether-based dials, polyester-based dials, polycarbonate dials and so forth. The use of polyether-based dials is particularly preferred from the viewpoint that they provide the yarn with flexibility and elongation.

The polyether-based dial preferably contains a copolymer dial compound that contains a unit represented by the general formula below.

Formula 1

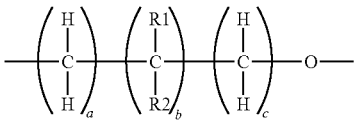

In the formula, a and c are integers from 1 to 3, b is an integer from 0 to 3, and R1 and R2 are hydrogen or an alkyl group having 1 to 3 carbons.

Specific examples of this polyether-based diol compound include polyethylene glycol, modified polyethylene glycol, polypropylene glycol, polytrimethylene ether glycol, polytetramethylene ether glycol (abbreviated as "PTMG" hereinafter), modified PTMG that is a copolymer of tetrahydrofuran (abbreviated as "THF" hereinafter) and 3-methyl-THF, modified PTMG that is a copolymer of THF and 2,3-dimethyl-THF, modified PTMG that is a copolymer of THF and neopentyl glycol, random copolymers in which THF and ethylene oxide and/or propylene oxide are irregularly arranged, and so forth. One type of these polyether-based glycols may be used, or two or more may be used as a mixture or copolymer. Among them, PTMG or modified PTMG is preferred.

Furthermore, from the viewpoint of increasing abrasion resistance and resistance to light in the polyurethane yarn, it is preferable to use a polyester-based glycol such as a polyester diol having a side chain obtained by condensation polymerization of adipic acid with a mixture of butylene adipate, polycaprolactone diol, 3-methyl-1,5-pentane diol and polypropylene diol, or a polycarbonate diol containing a dicarboxylic acid unit derived from a diol component and dicarboxylic acid component made up of 3,8-dimethyldecane dioxide and/or 3,7-dimethyldecane dioxide.

Such polymer diols may be used individually or as a mixture or copolymer of two or more types.

The molecular weight of the polymer diol used in the present invention depends on the levels of elongation, strength and heat resistance desired when made into elastic yarn, and is preferably 1000-8000 and more preferably 1800-6000 by number average molecular weight. By using a polymer diol with molecular weight in this range, an elastic yarn with excellent elongation, strength, elastic recovery force and heat resistance can be obtained.

As the diisocyante of the structural units that constitute the polyurethane, aromatic diisocyanates such as diphenylmethane diisocyanate (abbreviated as "MDI" hereinafter), tolylene diisocyanate, 1,4-diisocyanate benzene, xylylene diisocyanate, 2,6-naphthylene diisocyanate and so forth are advantageously used to synthesize polyurethane with particularly high heat resistance and strength. Additionally, preferred examples of alicyclic diisocyanates include methylene bis(cyclohexyl isocyanate), isophorone diisocyanate, methylcyclohexane 2-4-diisocyanate, methylcyclohexane 2,6-diisocyanate, cyclohexane 1,4-diisocyanate, hexahydroxylylene diisocyanate, hexahydrotolylene diisocyanate, octahydro 1,5-naphthylene diisocyanate and so forth. Aliphatic diisocyanates may be used effectively particularly to suppress yellowing of polyurethane elastic yarn. These diisocyanates may be used individually or in a combination of two or more types.

As the chain extender of the structural units that constitute the polyurethane, it is preferred that at least one type of low-molecular-weight diamine or low-molecular-weight diol is used. Note that it may also be one that has a hydroxyl group and an amino group in the molecule, like ethanolamine.

Preferred examples of low-molecular-weight diamines include ethylenediamine (abbreviated as "EDA" hereinafter), 1,2-propanediamine, 1,3-propanediamine, hexamethylenediamine, p-phenylenediamine, p-xylylenediamine, m-xylylenediamine, p,p'-methylenediamine, 1,3-cyclohexyldiamine, hexahydrometaphenylenediamine, 2-methylpentamethylenediamine, bis(4-aminophenyl)phosphine oxide, and so forth. One or two or more types among these are preferably used. Ethylenediamine is particularly preferred. By using ethylenediamine, yarn having excellent elongation, elastic recovery characteristics and heat resistance can be obtained. Triamine compounds, such as diethylenetriamine, for example, which can form a crosslinked structure in these chain extenders, may be used to an extent such that the advantageous effect is not lost.

Typical low-molecular-weight diols include ethylene glycol (abbreviated as "EG" hereinafter), 1,3 propanediol, 1,4 butanediol, bishydroxyethoxybenzene, bishydroxyethyleneterephthalate, 1-methyl-1,2-ethanediol, and so forth. One or two or more types among these are preferably used. Ethylene glycol, 1,3 propanediol and 1,4 butanediol are particularly preferred. When these are used, heat resistance as a dial-extended polyurethane is high, and a yarn having high strength can be obtained.

Additionally, in the polyurethane in the present invention, it is preferred that one or two or more types of terminal blocking agent is mixed in. Preferred examples of this terminal blocking agent include monoamines such as diethylamine, diisopropylamine, ethylmethylamine, diethylamine, methylpropylamine, isopropylmethylamine, diisopropylamine, butylmethylamine, isobutylmethylamine, isopentylmethylamine, dibutylamine and diamylamine, monools such as ethanol, propanol, butanol, isopropanol, allyl alcohol and cyclopentanol, monoisocyanates such as phenyl isocyanate, and so forth.

The molecular weight of the polyurethane in the present invention is preferably in the range from 40,000 to 150,000 as number average molecular weight, from the viewpoint of obtaining fiber with high durability and strength. Note that molecular weight is the value measured by GPC and converted in terms of polystyrene.

The polyurethane that constitutes the elastic yarn of the present invention is particularly preferably made up of diol and diisocyanate and has a melting point at the high-temperature side in the range of 150° C. to 300° C. from the viewpoint of obtaining excellent heat resistance without any problems in practical use including the ability to pass through the process steps. Here, the melting point at the high-temperature side is the melting point of the so-called hard segment crystals of polyurethane or polyurethane urea when measured by DSC.

That is to say, the polyurethane is preferably synthesized using PTMG having molecular weight in the range from 1000 to 8000 as the polymer diol, MDI as the diisocyanate, and at least one selected from the group made up of ethylene glycol, 1,3 propanediol, 1,4 butanediol, ethylenediamine, 1,2-propanediamine and 1,3-propanediamine as the chain extender, and elastic yarn produced from polyurethane having a melting point at the high-temperature side in the range from 150° C. to 300° C. is preferred because it has particularly high elongation, and, as described above, has excellent heat resistance without any problems in practical use including the ability to pass through the process steps.

The polyurethane elastic yarn of the present invention made up of the polyurethane described above is characterized by comprising at least one among (A) a benzotriazole-based ultraviolet light absorbent and/or benzophenone-based ultraviolet light absorbent containing at least one unsaturated bond in the molecule, (B) a benzotriazole-based ultraviolet light absorbent containing at least one alkoxy group in the molecule, and (C) a benzophenone-based ultraviolet light absorbent containing at least one sulfonic acid group in the molecule.

The benzotriazole-based ultraviolet light absorbent that contains at least one unsaturated bond in the molecule used in the present invention is not particularly limited, provided that it is a compound in which a compound residue having an unsaturated bond is substituted for an aromatic hydrogen atom of an aromatic heterocyclic compound having a benzotriazole skeleton—for example, a compound in which a compound having an unsaturated bond is polymerized as a monomer with a compound having a benzotriazole skeleton. In this case, only a compound having an unsaturated bond may be used as the monomer, or a copolymer containing other monomers may be used as the monomer. Furthermore, as the compound having an unsaturated bond, vinyl compounds, allyl compounds, unsaturated carboxylic acids and so forth are preferred.

Specific examples of such ultraviolet light absorbents are those having the structure shown in Formula 2. Among them, copolymers with compounds having benzotriazole skeletons and unsaturated carboxylic acid-based compounds such as acrylic acid skeletons and methacrylic acid skeletons are more preferred from the viewpoints of strength and elongation characteristics (fracture strength, fracture elongation) and recovery characteristics, and copolymers with compounds having methacrylic acid skeletons and compounds having benzotriazole skeletons are particularly preferred from the viewpoints of stability of the spinning solution and spinning continuity.

Formula 2

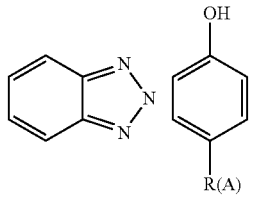

Here, R(A) is a monovalent organic group containing at least one unsaturated bond.

Specific preferred examples include 2-(2'-hydroxy-3'-allyl-5'-t-butylphenyl)-benzotriazole, 2-(2'-hydroxy-3'-allyl-5'-t-octylphenyl)benzotriazole, 2-(2'-hydroxy-3'-isopropenyl-5'-t-butylphenyl)benzotriazole, 2-(2'-hydroxy-3'-isopropenyl-5'-t-octylphenyl)benzotriazole, 2-(2'-acryloyloxy-5'-methyl)benzotriazole, 2-(2'-hydroxy-5'-methacryloxymethylphenyl)-2H-benzotriazole, 2-(2'-hydroxy-5'-methacryloxyethyl-phenyl)-2H-benzotriazole and 2-(2'-hydroxy-5'-methacryloxypropylphenyl)-2H-benzotriazole, and above all, the 2-(Z-hydroxy-5'-methacryloxymethylphenyl)-2H-benzotriazole shown in Formula 3 is particularly preferred from the viewpoints of strength and elongation characteristics, recovery characteristics and spinning characteristics.

Formula 3

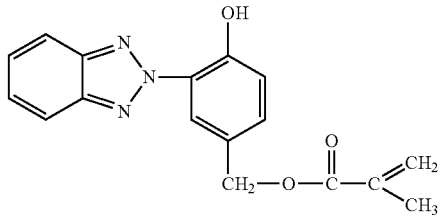

The benzophenone-based ultraviolet light absorbent that contains at least one unsaturated bond in the molecule used in the present invention is not particularly limited, provided that it is a compound in which a compound residue having an unsaturated bond is substituted for an aromatic hydrogen atom of an aromatic heterocyclic compound having a benzophenone skeleton—for example, a compound in which a compound having an unsaturated bond is polymerized as a monomer with a compound having a benzophenone skeleton. In this case, only a compound having an unsaturated bond may be used as the monomer, or a copolymer containing other monomers may be used as the monomer. Furthermore, as the compound having an unsaturated bond, vinyl compounds, allyl compounds, unsaturated carboxylic acids and so forth are preferred.

Specific examples of such ultraviolet light absorbents are those having the structure shown in Formula 4. Among them, copolymers with compounds having benzophenone skeletons and unsaturated carboxylic acid-based compounds such as acrylic acid skeletons and methacrylic acid skeletons are more preferred from the viewpoints of strength and elongation characteristics (fracture strength, fracture elongation)

and recovery characteristics, and copolymers with compounds having methacrylic acid skeletons and compounds having benzotriazole skeletons are particularly preferred from the viewpoints of ultraviolet light absorbent loss and stability of the spinning solution and spinning continuity.

Formula 4

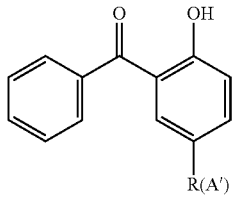

Here, R(A') is a monovalent organic group containing at least one unsaturated bond.

Specific preferred examples include 2-hydroxy-3-allyl-5-t-butylbenzo-phenone, 2-hydroxy-3-allyl-5-octylbenzophenone, 2-hydroxy-3-isopropenyl-5-t-butylbenzophenone, 2-hydroxy-3-isopropenyl-5-t-octylbenzophenone, 2-acryloyloxy-5-methylbenzophenone, 2-hydroxy-5-methacryloxymethylbenzophenone and 2-hydroxy-5-methacryloxyethyl-benzophenone, and above all, the 2-hydroxy-5-methacryloxyethylbenzophenone shown in Formula 5 is particularly preferred from the viewpoints of ultraviolet light absorbent loss, strength and elongation characteristics and recovery characteristics.

Formula 5

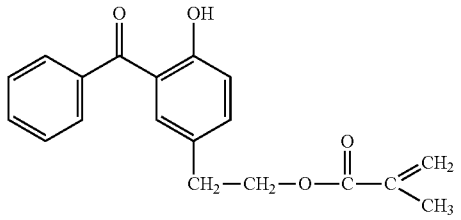

The benzotriazole-based ultraviolet light absorbent that contains at least one alkoxy group in the molecule used in the present invention is not particularly limited, provided that it is a compound that has a benzotriazole skeleton containing at least one alkoxy group. That having an alkoxy group having from 1 to 40 carbons, more preferably from 1 to 35 carbons, even more preferably from lto 24 carbons, and most preferably from 6 to 20 carbons, is advantageous for improving strength and elongation characteristics and recovery characteristics, and is also advantageous from the viewpoint of spinning characteristics. Furthermore, it may also contain other functional groups, it may contain halogens from the viewpoint of miscibility with polyurethane, and it may contain a plurality of benzotriazole skeletons. Above all, the structure shown in Formula 6 is preferred.

Formula 6

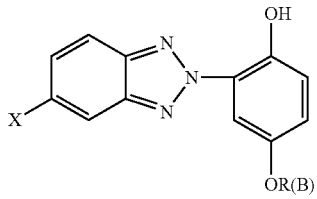

Here, R(B) is a monovalent organic group and X is a monovalent organic group or a halogen atom.

Specific preferred examples include 2-(2'-hydroxy-4'-octyloxyphenyl) benzotriazole, 2-(2'-hydroxy-4'-octadecyloxyphenyl)benzotriazole, 2-(2'-hydroxy-4'-(3-methylpentyloxy)phenyl)benzotriazole, 2-(2'-hydroxy-4'-(3-methyldecyloxy)phenyl) benzotriazole, 2-(2'-hydroxy-4'-methyloxyphenyl)-5-chloro-benzotriazole, 2-(2'-hydroxy-4'-octyloxyphenyl)-5-chloro-benzotriazole, 2-(2'-hydroxy-4'-hexadecyloxyphenyl)-5-chloro-benzotriazole, 2-(2'-hydroxy-4'-octadecyloxyphenyl)-5-chloro-benzotriazole, 2-(2'-hydroxy-4'-octyloxyphenyl)-5-chloro-benzotriazole, 2-(2'-hydroxy-4'-octyloxyphenyl)-5-methyloxy-benzotriazole, 2-(2'-hydroxy-4'-octyloxyphenyl)-5-ethyloxy-benzotriazole, 2-(2'-hydroxy-4'-octyloxyphenyl)-5-octyloxy-benzotriazole and so forth.

The benzophenone-based ultraviolet light absorbent that contains at least one sulfonic acid group in the molecule used in the present invention is not particularly limited, provided that it is a compound having a benzophenone skeleton that contains at least one sulfonic acid group, and the sulfonic acid group may also contain some salts such as sodium sulfonate and potassium sulfonate. Preferably, derivatives of 2A-dihydroxybenzophenonesulfonic acid are advantageous for improving strength and elongation characteristics and recovery characteristics. Additionally, it may contain other functional groups. In particular, the inclusion of an alkoxy group heightens the effect of increasing stress when strain is applied in the region of actual use of the yarn, and is also advantageous from the viewpoint of spinning characteristics. Above all, the structure shown in Formula 7 is preferred.

Formula 7

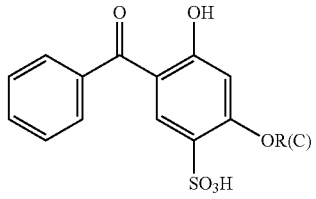

Here, R(C) is a monovalent organic group.

Specific preferred examples include 2A-dihydroxy-benzophenonesulfonic acid, 2-hydroxy-4-methoxybenzophenone-5-sulfonic acid, a mixture of 2-hydroxy-4-methoxybenzophenone-5-sulfonic acid and 2-hydroxy-4-methyoxybenzophenone-5-sodium sulfonate, 2-hydroxy-4-methoxybenzophenone-6-sulfonic acid, 2-hydroxy-4-ethoxybenzophenone-5-sulfonic acid, 2-hydroxy-4-octyloxybenzophenone-5-sulfonic acid, 2-hydroxy-4-octyloxybenzophenone-5-sulfonic acid and so forth.

In the present invention, the amount of the aforementioned ultraviolet light absorbents is preferably in the range from 0.5 wt % to 15 wt % of the total weight of polyurethane elastic yarn from the viewpoint of obtaining good ability to pass through the process steps and spinning characteristics, and even more preferably from 0.5 wt % to 5 wt % of the total weight of polyurethane elastic yarn from the viewpoint of minimizing reductions in chemical resistance, heat resistance and so forth of the polyurethane elastic yarn. Note that these contained amounts are preferably tested and appropriately determined beforehand in accordance with the application.

Furthermore, in the present invention, various stabilizers, pigments and so forth may be included in the polyurethane elastic yarn and polyurethane spinning solution. For example, as antioxidants and so forth, 2,6-di-t-butyl-p-cresol (BHT) or hindered phenol-based chemicals such as Sumilizer GA-80 made by Sumitomo Chemical Co., ltd., benzotriazole-based chemicals aside from the aforementioned ultraviolet light absorbents of (A) through (C) such as Tinuvin® made by Ciba-Geigy, benzophenone-based, benzoate-based and triazine-based chemicals, phosphorus-based chemicals such as Sumilizer P-16 made by Sumitomo Chemical Co., Ltd., various hindered amine-based chemicals, various inorganic pigments such as iron oxide, titanium oxide and carbon black, fluorine-based or silicone-based resin powders, metal soaps such as magnesium stearate, disinfectants containing silver or zinc or compounds thereof, deodorizers, lubricants such as silicones and mineral oils, and various antistatic agents such as barium sulfate, cerium oxide, betaine or phosphoric acid-based agents are also preferably included, and may be reacted with polymers. Additionally, to further increase durability against light and various nitrogen oxides, nitrogen oxide scavengers are also preferably used.

Furthermore, from the viewpoints of improving heat resistance and improving functionality, inorganic substances or inorganic porous substances (for example, bamboo charcoal, wood charcoal, carbon black, porous mud, clay, diatomaceous earth, activated coconut shell charcoal, petroleum-based activated charcoal, zeolite, pearlite, etc.) may also be added within a range that does not hinder the advantageous effects of the present invention.

Next, the method for producing polyurethane elastic yarn of the present invention will be described in detail.

In the production method of the present invention, when producing elastic yarn made up of polyurethane having the starting substances of polymer diol and diisocyanate, at least one among (A), (B) and (C) below is included in a spinning starting solution containing polyurethane:

(A) a benzotriazole-based ultraviolet light absorbent and/or benzophenone-based ultraviolet light absorbent containing at least one unsaturated bond in the molecule, (B) a benzotriazole-based ultraviolet light absorbent containing at least one alkoxy group in the molecule, (C) a benzophenone-based ultraviolet light absorbent containing at least one sulfonic acid group in the molecule.

In including the ultraviolet light absorbents of (A) through (C) in the spinning starting solution, it is preferable to first prepare the polyurethane solution and then add the aforementioned ultraviolet light absorbents to that polyurethane solution.

As the method for producing the polyurethane solution or the polyurethane that is the solute in that solution, melt polymerization or solution polymerization may be used, or other methods may also be used. However, solution polymerization is more preferred. In the case of solution polymerization, there is little generation of foreign matter such as gel in the polyurethane, and therefore it is easily spun and readily produces poly-urethane elastic yarn of low fineness. Furthermore, solution polymerization has the advantage that there is no need for a dissolution operation.

Polyurethane that is particularly advantageous in the present invention is one synthesized using PTMG of molecular weight from 1000 to 8000 as the polymer diol, using MDI as the diisocyanate, and, as the chain extender, using at least one type among ethylene glycol, 1,3 propanediol, 1A butanediol, ethylenediamine, 1,2-propanediamine and 1,3-propanediamine, and that has a melting point at the high-temperature side of 150° C. to 300° C., more preferably 200° C. to 300° C.

Such polyurethane is obtained by synthesis using the aforementioned starting materials in DMAc, DMF, DMSO or NMP, or a solvent containing these as main components. For example, particularly advantageous methods that can be employed include the so-called one-shot method wherein polyurethane is made by putting the starting materials in such a solvent, dissolving them, and heating to an appropriate temperature and reacting, and a method wherein polymer diol and diisocyanate are first melt-reacted, and a short time later, the reactant is dissolved in a solvent and reacted with the diol described above to produce polyurethane.

In cases where a diol is used in the chain extender, a typical method for ensuring the melting point at the high-temperature side of the polyurethane is in the range from 150° C. to 300° C. is to control the types and ratios of polymer diol, MDI and diol. For example, if the molecular weight of the polymer dial is low, polyurethane with a high melting point at the high-temperature side can be obtained by increasing the relative proportion of MDI. Similarly, if the molecular weight of the dial is low, polyurethane with a high melting point at the high-temperature side can be obtained by reducing the relative proportion of polymer dial. If the molecular weight of the polymer dial is 1800 or higher, it is preferable if polymerization proceeds with the mole ratio of MDI to polymer dial equal to 1.5 or above in order to obtain a melting point at the high-temperature side of 150° C. or above.

Note that when synthesizing such polyurethane, one or more catalysts such as amine-based catalysts and organometallic catalysts is preferably used.

Examples of amine-based catalysts include N,N-dimethylcyclohexylamine, N,N-dimethylbenzylamine, triethylamine, N-methylmorpholine, N-ethylmorpholine,N,N,N',N'-tetramethylethylenediamine, N,N,N',N'-tetramethyl-1,3-propanediamine, N,N,N',N'-tetramethylhexanediamine, bis-2-dimethylaminoethylether, N,N,N',N',N'-pentamethyldiethylenetriamine, tetramethylguanidine, triethylenediamine, N,N'-dimethylpiperazine, N-methyl-N'-dimethylaminoethyl-piperazine, N-(2-dimethylaminoethyl) morpholine, 1-methylimidazole, 1,2-dimethylimidazole, N,N-dimethylaminoethanol, N,N,N'-trimethylaminoethylethanolamine, N-methyl-N'-(2-hydroxyethyl)piperazine, 2A,6-tris(dimethylaminomethyl)phenol, N,N-dimethylaminohexanol, triethanolamine and so forth.

Examples of organometallic catalysts include tin octanoate, dibutyltin dilaurate, dibutyl lead octanoate and so forth.

The concentration of polyurethane in the polyurethane solution obtained in this manner is normally preferably in the range of 30 wt % to 80 wt %.

In the present invention, it is preferred that at least one among the aforementioned (A) through (C) is added to the polyurethane solution. Any method can be used to add the aforementioned ultraviolet light absorbents of (A) through (C) to the polyurethane solution. As typical methods, methods that use a variety of means can be employed, such as methods using a static mixer, methods by stirring, methods using a homomixer, and methods using a biaxial extruder. From the viewpoint of homogenous addition to the polyurethane solution, it is preferable to add the ultraviolet light absorbents of the aforementioned (A) through (C) after dissolving them in solution.

Note that by adding the ultraviolet light absorbents of the aforementioned (A) through (C) to the polyurethane solution, a phenomenon may occur wherein the viscosity of the mixed solution after addition is unexpectedly higher than before addition. From the viewpoint of preventing this phenomenon, it is preferable to mix in one or two or more terminal blocking agents such as monoamines such as dimethylamine, diisopropylamine, ethylmethylamine, diethylamine, methylpropylamine, isopropylmethylamine, diisopropylamine, butylmethylamine, isobutylmethylamine, isopentylmethylamine, dibutylamine and diamylamine, monools such as ethanol, propanol, butanol, isopropanol, allyl alcohol and cyclopentanol, and monoisocyanates such as phenyl isocyanate.

When adding the ultraviolet light absorbents of the aforementioned (A) through (C) to the polyurethane solution, the aforementioned chemicals such as light resistance agents and antioxidants and pigments and so forth may be added at the same time.

The polymer elastic yarn of the present invention can be obtained by dry spinning, wet spinning or melt spinning the spinning starting solution constituted as described above and then winding. Among these methods, dry spinning is preferred from the viewpoint that stable spinning is possible at any fineness from thin to thick.

The fineness, number of individual filaments, cross-sectional shape and so forth of the polyurethane elastic yarn of the present invention are not particularly limited. For example, the yarn may be a monofilament constituted of one individual filament, or it may be a multifilament constituted of a plurality of individual filaments. The cross-sectional shape of the yarn may be round or flat.

The dry spinning method is not particularly limited, and spinning may be performed by appropriately selecting the spinning conditions that suit the desired characteristics and the spinning equipment.

For example, since permanent strain and stress relief characteristics of the polyurethane elastic yarn of the present invention are readily influenced by the speed ratio of the Godet roller and winder, it is preferable to appropriately determine this ratio in accordance with the purpose of use of the yarn. That is, from the viewpoint of obtaining polyurethane elastic yarn having the desired permanent strain and stress relief, it is preferable to wind the yarn with the speed ratio of the Godet roller and winder in the range of 1.15 to 1.65. To obtain polyurethane elastic yarn having particularly high permanent strain and low stress relief, the speed ratio of the Godet roller and winder is preferably in the range of 1.15 to 1.4, and more preferably in the range of 1.15 to 1.35. On the other hand, to obtain polyurethane elastic yarn having particularly low permanent strain and high stress relief, it is preferable to wind the yarn with the speed ratio of the Godet roller and winder in the range of 1.25 to 1.65, and more preferably in the range of 1.35 to 1.65.

Since the strength of the polyurethane elastic yarn can be improved by increasing the spinning speed, a spinning speed of at least 450 m/minute is preferred for reaching a strength level that is advantageous for practical use. If industrial production is also taken into consideration, 450-1000 m/minute is preferred.

EXAMPLES

The present invention is described in further detail below by means of examples.

First are described the method of analyzing the benzotriazole-based ultraviolet light absorbents containing at least one unsaturated bond in the molecule in the polyurethane elastic yarn in the present invention, and the methods of measuring strength, elongation, permanent strain, stress relief, durability against light radiation, whiteness retention against light radiation, durability against light radiation after immersion in organic solvent and whiteness retention against light radiation after immersion in organic solvent of the polyurethane elastic yarn in the present invention.

Method of Analyzing Ultraviolet Light Absorbent in Yarn

Approximately 10 mg of yarn sample was dissolved in 10 ml of DMAc, and analysis was performed by high performance liquid chromatography. The high performance liquid chromatography detector utilized a UV detector and a measurement wavelength of 340 nm. A calibration curve created in advance using solutions of the respective ultraviolet light absorbents (A) through (C) whose concentrations had been determined were used in quantification. The content was determined by the formula below.

Content ratio (wt %)=(Yarn, sample peak area/Calibration curve peak area)×Calibration curve sample weight/Yarn sample weight×100

Permanent strain, stress relief, fracture strength, fracture elongation, strength in region of actual use.

Using an Instron model 4502 tensile tester, permanent strain, stress relief, fracture strength and fracture elongation were measured by tensile testing of the polyurethane elastic yarn. The number of measurements was n=3, and the average thereof was used.

A sample 5 cm long (L1) was stretched 300% at a pulling rate of 50 cm/minute, and this was performed five times. The stress when stretched 300% for the fifth time was taken as GI. Then, the sample was stretched 300% and held for 30 seconds. The stress after holding for 30 seconds was taken as G2. Next, the stretch of the sample was allowed to recover, and the length of the sample when the stress was 0 was taken as L2. When performed a sixth time, the sample was stretched until it broke. The stress at fracture was taken as G3, and the sample length at fracture was taken as L3. The aforementioned characteristics were calculated by the formulas below.

Fracture strength $(eN)=(G3)$

Stress relief $(\%)=100\times((G1)-(G2))/(G1)$

Permanent strain $(\%)=100\times((L2)-(L1))/(L1)$

Fracture elongation $(\%)=100\times((L3)-(L1))/(L1)$

Also, strain and stress at the time of recovery after being held for 30 seconds for the fifth time were plotted. The stress at 200% strain was taken as P-200, and the elasticity characteristics at a prescribed fineness (20 dtex) were calculated as the strength in the region of actual use.

Durability Against Light Radiation.

Yarn was affixed while stretched 100% and UV exposure treatment was performed. The UV exposure treatment was performed at temperature 63° and relative humidity 60% using a carbon arc fadometer made by Suga Test Instruments. After the exposure treatment was performed a total of two times, the yarn was left to stand free for 24 hours at room temperature, and fracture strength (G4) was measured by the same method as above. The ratio (retention rate) of the fracture strength after treatment (G4) to the fracture strength (G3) of the untreated yarn was taken as the chemical resistance. The number of measurements was n=3, and the average thereof was used.

Durability against light radiation $(\%)=100\times(G4)/(G3)$

Whiteness Retention Against Light Radiation.

Yarn was wound closely around a sample sheet with a minimum load (1.05 in terms of elongation ratio) to the degree that there was no influence from the color of the sample sheet, and this was used as the sample which underwent UV exposure treatment. The UV exposure treatment was performed at temperature 63° and relative humidity 60% using a carbon arc fadometer made by Suga Test Instruments. The exposure treatment was performed a total of two times. After exposure treatment, the b value of the sample was measured, and whiteness retention was judged. The b value was measured according to JIS L 1013: 1999 method C (Hunter method), and calculated based on the formula below using a Hunter color' difference meter. The number of measurements was three, and the average thereof was used.

$$b=7.0(Y-0.847Z)/Y^{1/2}$$

Here, X, Y and Z were calculated according to JIS Z 8701: 1999.

A b value of less than 1.5 was judged as excellent, 1.5 to less than 3 was judged as good, 3 to less than 5 was judged as fair, and 5 or above was judged as poor.

Durability Against Light Radiation after Immersion in Organic Solvent.

Yarn was immersed in tetrachloroethylene used in dry cleaning and so forth for approximately 1 hour. After that, the yarn was removed and blown dry, thereby removing the tetrachloroethylene. Durability (%) was calculated by the same method as durability against light radiation described above.

Whiteness Retention Against Light Radiation after Immersion in Organic Solvent.

Yarn was immersed in tetrachloroethylene used in dry cleaning and so forth for approximately 1 hour. After that, the yarn was removed and blown dry, thereby removing the tetrachloroethylene. Whiteness retention was calculated by the same method as whiteness retention against light radiation described above.

Example 1

A DMAC solution (35 wt %) of polyurethane polymer made up of PTMG of molecular weight 2900, MDI and ethylene glycol was polymerized by ordinary methods, to make polymer solution P1.

Then, a DMAc solution thereof A1 (35 wt %) was prepared using 2-(2'-hydroxy-3'-isopropenyl-5'-t-butylphenyl)benzotriazole as a benzotriazole-based ultraviolet light absorbent containing at least one unsaturated bond in the molecule.

Additionally, as an antioxidant, a polyurethane solution produced by reacting t-butyldiethanolamine and methylene-bis-(4-cyclohexyl isocyanate) (DuPont Methacrol® 2462, c1) was mixed in a 2:1 ratio (weight ratio) with a condensation polymer of p-cresol and divinylbenzene (DuPont Methacrol® 2390, c2), thereby preparing an antioxidant DMAc solution (concentration 35 wt %), and this was used as the other additive solution B1 (35 wt %).

The polymer solution P1, the solution A1 of benzotriazole-based ultraviolet light absorbent containing at least one unsaturated bond in the molecule, and the other additive solution B1 were homogenously mixed in amounts of 94 wt %, 3 wt % and 3 wt %, respectively, to make spinning solution D1. This spinning solution was dry-spun and wound at a spinning speed of 540 m/minute with a speed ratio of the Godet roller and winder of 1.4, thereby producing 20 dtex monofilament polyurethane elastic yarn (200 g spool) in which the content of benzotriazole-based ultraviolet light absorbent containing at least one unsaturated bond in the molecule was 3 wt %.

The composition (wt %) of the obtained polyurethane elastic yarn was as shown in Table 1. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and fracture elongation were greater than in comparative example 1 (described below), which contained no benzotriazole-based ultraviolet light absorbent containing at least one unsaturated bond in the molecule, and comparative example 3 (described below), which contained benzotriazole-based ultraviolet light absorbent that did not contain any unsaturated bonds in the molecule. The values of permanent strain and stress relief were lower than in comparative example 1 and comparative example 3, and recovery characteristics were better. Durability against light radiation and durability against light radiation after immersion in organic solvent were more than twice as high as in comparative example 1. Compared to comparative example 3, durability against light radiation before immersion in organic solvent was the same, but durability after immersion in organic solvent was more than twice as high as in comparative example 3. Whiteness retention against light radiation and whiteness retention against light radiation after immersion in organic solvent were both greatly improved compared to comparative example 1, and although it was the same as in comparative example 3 before immersion in organic solvent, it was better after immersion in organic solvent.

Example 2

A DMAc solution was prepared by the same method as in example 1 except that 2-(2'-hydroxy-5'-methacryloxymethylphenyl)-2H-benzotriazole (compound of the aforementioned Chem. 3) was used as the benzotriazole-based ultraviolet light absorbent containing at least one unsaturated bond in the molecule, and this was used as DMAc solution A2 (35 wt %).

The polymer solution P1 prepared in example 1, the aforementioned ultraviolet light absorbent solution A2 and the other additive solution B1 were homogenously mixed in amounts of 94 wt %, 3 wt % and 3 wt %, respectively, to make spinning solution D2.

This spinning solution was dry-spun and wound at a spinning speed of 540 m/minute with a speed ratio of the Godet roller and winder of 1.4, thereby producing 20 dtex monofilament polyurethane elastic yarn (200 g spool) in which the content of benzotriazole-based ultraviolet light absorbent containing at least one unsaturated bond in the molecule was 3 wt %.

The composition (wt %) of the obtained polyurethane elastic yarn was as shown in Table 1. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and fracture elongation were greater than in comparative example 1 (described below), which contained no benzotriazole-based ultraviolet light absorbent containing at least one unsaturated bond in the molecule, and comparative example 3 (described below), which contained benzotriazole-based ultraviolet light absorbent that did not contain any unsaturated bonds in the molecule. The values of permanent strain and stress relief were lower than in comparative example 1 and comparative example 3, and recovery characteristics were better. Durability against light radiation and durability against light radiation after immersion in organic solvent were more than twice as high as in comparative example 1. Compared to comparative example 3, durability against light radiation before immersion in organic solvent was approximately 1.1 times greater, but durability after immersion in organic solvent was more than twice as high as in comparative example 3. Whiteness retention against light radiation and whiteness retention against light radiation after immersion in organic solvent were both greatly improved compared to comparative example 1, and although it was the same as in comparative example 3 before immersion in organic solvent, it was better after immersion in organic solvent.

Example 3

A DMAc solution (35 wt %) of polyurethane polymer (P2) made up of PTMG of molecular weight 1800, MDI, ethylenediamine and diethylamine as a terminal blocking agent was polymerized by ordinary methods, to make polymer solution P2.

Then, this DMAc solution P2, the ultraviolet light absorbent solution A1 prepared in example 1 and the other additive solution B1 were homogenously mixed in amounts of 94.0 wt %, 3.0 wt % and 3.0 wt %, respectively, to make spinning solution D3. This spinning solution D3 was dry-spun and wound at a spinning speed of 600 m/minute with a speed ratio of the Godet roller and winder of 1.20, thereby producing 20 dtex monofilament polyurethane elastic yarn (500 g spool) in which the content of benzotriazole-based ultraviolet light absorbent containing at least one unsaturated bond in the molecule was 3 wt %.

The composition (wt %) of the obtained polyurethane elastic yarn was as shown in Table 1. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and elongation were greater than in comparative example 2, which contained no benzotriazole-based ultraviolet light absorbent containing at least one unsaturated bond in the molecule, and comparative example 4 (described below) which contained benzotriazole-based ultraviolet light absorbent that did not contain any unsaturated bonds in the molecule. The values of permanent strain and stress relief were lower than in comparative example 2 and comparative example 4, and recovery characteristics were better. Durability against light radiation and durability against light radiation after immersion in organic solvent were more than twice as high as in comparative example 2. Compared to comparative example 4, durability against light radiation before immersion in organic solvent was approximately 15% greater, but durability after immersion in organic solvent was more than twice as high as in comparative example 4. Whiteness retention against light radiation and whiteness retention against light radiation after immersion in organic solvent were both greatly improved compared to comparative example 1, and although it was the same as in comparative example 4 before immersion in organic solvent, it was much better 4 after immersion in organic solvent.

Example 4

The polymer solution P2 prepared in example 3, the ultraviolet light absorbent solution A2 prepared in example 2 and the other additive solution B1 prepared in example 1 were homogenously mixed in amounts of 94.0 wt %, 3.0 wt % and 3.0 wt %, respectively, to make spinning solution D4. This spinning solution D4 was dry-spun and wound at a spinning speed of 600 m/minute with a speed ratio of the Godet roller and winder of 1.3, thereby producing 20 dtex two-filament multifilament polyurethane elastic yarn (500 g spool) in which the content of benzotriazole-based ultraviolet light absorbent containing at least one unsaturated bond in the molecule was 3 wt %.

The composition (wt %) of the obtained polyurethane elastic yarn was as shown in Table 1.

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and elongation were greater than in comparative example 2, which contained no benzotriazole-based ultraviolet light absorbent containing at least one unsaturated bond in the molecule, and comparative example 4 (described below), which contained benzotriazole-based ultraviolet light absorbent that did not contain any unsaturated bonds in the molecule. The values of permanent strain and stress relief were lower than in comparative example 2 and comparative example 4, and recovery characteristics were better. Durability against light radiation and durability against light radiation after immersion in organic solvent were more than twice as high as in comparative example 2. Compared to comparative example 4, durability against light radiation before immersion in organic solvent was approximately 15% greater, but durability after immersion in organic solvent was more than twice as high as in comparative example 4. Whiteness retention against light radiation and whiteness retention against light radiation after immersion in organic solvent were both greatly improved compared to comparative example 1, and although it was the same as in comparative example 4 before immersion in organic solvent, it was much better after immersion in organic solvent.

Example 5

The polymer solution P2 prepared in example 3, the ultraviolet light absorbent solution A2 prepared in example 2 and the other additive solution B1 prepared in example 1 were homogenously mixed in amounts of 96.7 wt %, 0.3 wt % and 3.0 wt %, respectively, to make spinning solution D5.

This spinning solution D5 was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 1. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and elongation were greater than in comparative example 2, which contained no benzotriazole-based ultraviolet light absorbent containing at least one unsaturated bond in the molecule, and comparative example 4 (described below), which contained benzotriazole-based ultraviolet light absorbent that did not contain any unsaturated bonds in the molecule. The values of permanent strain and stress relief were lower than in comparative example 2 and comparative example 4, and recovery characteristics were better. Durability against light radiation and durability against light radiation after immersion in organic solvent were more than twice as high as in comparative example 2. Compared to comparative example 4, durability against light radiation before immersion in organic solvent was the same, but durability after immersion in organic solvent was more than 1.5 times as high as in comparative example 4. Whiteness retention against light radiation and whiteness retention against light radiation after immersion in organic solvent were both greatly improved compared to comparative example 1, and although it was the same as in comparative example 4 before immersion in organic solvent, it was better after immersion in organic solvent.

Example 6

The polymer solution P2 prepared in example 3, the ultraviolet light absorbent solution A2 prepared in example 2 and the other additive solution B1 prepared in example 1 were homogenously mixed in amounts of 96.3 wt %, 0.7 wt % and 3.0 wt %, respectively, to make spinning solution D6.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 1. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and elongation were greater than in comparative example 2, which contained no benzotriazole-based ultraviolet light absorbent containing at least one unsaturated bond in the molecule, and comparative example 4 (described below), which contained benzotriazole-based ultraviolet light absorbent that did not contain any unsaturated bonds in the molecule. The values of permanent strain and stress relief were lower than in comparative example 2 and comparative example 4, and recovery characteristics were better. Durability against light radiation and durability against light radiation after immersion in organic solvent were more than 2.5 times higher than in comparative example 2. Compared to comparative example 4, durability against light radiation before immersion in organic solvent was the same, but durability after immersion in organic solvent was 2.0 times as high as in comparative example 4. Whiteness retention against light radiation and whiteness retention against light radiation after immersion in organic solvent were both greatly improved compared to comparative example 1, and although it was the same as in comparative example 4 before immersion in organic solvent, it was better after immersion in organic solvent.

Example 7

The polymer solution P2 prepared in example 3, the ultraviolet light absorbent solution A2 prepared in example 2 and the other additive solution B1 prepared in example 1 were homogenously mixed in amounts of 84.0 wt %, 13.0 wt % and 3.0 wt %, respectively, to make spinning solution D7.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 1. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and elongation were greater than in comparative example 2, which contained no benzotriazole-based ultraviolet light absorbent containing at least one unsaturated bond in the molecule, and comparative example 4 (described below), which contained benzotriazole-based ultraviolet light absorbent that did not contain any unsaturated bonds in the molecule. The values of permanent strain and stress relief were lower than in comparative example 2 and comparative example 4, and recovery characteristics were better. Durability against light radiation and durability against light radiation after immersion in organic solvent were more than 2.5 times higher than in comparative example 2. Compared to comparative example 4, durability against light radiation before immersion in organic solvent was the same, but durability after immersion in organic solvent was more than 2.0 times as high as in comparative example 4. Whiteness retention against light radiation and whiteness retention against light radiation after immersion in organic solvent were both greatly improved compared to comparative example 1, and although it was the same as in comparative example 4 before immersion in organic solvent, it was better after immersion in organic solvent.

Example 8

The polymer solution P2 prepared in example 3, the ultraviolet light absorbent solution A2 prepared in example 2 and the other additive solution B1 prepared in example 1 were homogenously mixed in amounts of 80.0 wt %, 17.0 wt % and 3.0 wt %, respectively, to make spinning solution D8.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 1. The fracture elongation, fracture strength, strength in region of actual use, permanent strain, stress relief durability against light radiation, whiteness retention against light radiation, durability against light radiation after immersion in organic solvent and whiteness retention against light radiation after immersion in organic solvent of this polyurethane elastic yarn are shown in Table 2. Fracture strength and elongation were greater than in comparative example 2, which contained no benzotriazole-based ultraviolet light absorbent containing at least one unsaturated bond in the molecule, and comparative example 4 (described below) which contained benzotriazole-based ultraviolet light absorbent that did not contain any unsaturated bonds in the molecule. The values of permanent strain and stress relief were lower than in comparative example 2 and comparative example 4, and recovery characteristics were better. Durability against light radiation and durability against light radiation after immersion in organic solvent were more than twice as high as in comparative example 2. Compared to comparative example 4, durability against light radiation before immersion in organic solvent was the same, but durability after immersion in organic solvent was more than 1.5 times higher than in comparative example 4. Whiteness retention against light radiation and whiteness retention against light radiation after immersion in organic solvent were both greatly improved compared to comparative example 1, and although it was the same as in comparative example 4 before immersion in organic solvent, it was better after immersion in organic solvent.

Comparative Example 1

The polymer solution P1 prepared in example 1 and the other additive solution B1 prepared in example 1 were homogenously mixed in amounts of 97 wt % and 3 wt %, respectively, to make spinning solution E1. This spinning solution E1 was dry-spun and wound at a spinning speed of 540 m/minute with a speed ratio of the Godet roller and winder of 1.40, thereby producing 20 dtex monofilament polyurethane elastic yarn.

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and fracture elongation were lower than in examples 1 and 2, and permanent strain and stress relief were higher than in examples 1 and 2, and recovery characteristics were worse. Durability against light radiation, whiteness retention against light radiation, and durability against light radiation and whiteness retention against light radiation after immersion in organic solvent were all much worse than in examples 1 and 2. Additionally, color tone was worse than in examples 1 and 2.

Comparative Example 2

The polymer solution P2 prepared in example 3 and the other additive solution B1 prepared in example 1 were homogenously mixed in amounts of 97 wt % and 3 wt %, respectively, to make spinning solution E2. This spinning solution E2 was dry-spun and wound at a spinning speed of 600 m/minute with a speed ratio of the Godet roller and winder of 1.20, thereby producing 20 dtex two-filament multifilament polyurethane elastic yarn (500 g spool).

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and fracture elongation were lower than in examples 3-5, and permanent strain and stress relief were higher than in examples 3-5, and recovery characteristics were worse. Durability against light radiation, whiteness retention against light radiation, and durability against light radiation and whiteness retention against light radiation after immersion in organic solvent were all much worse than in examples 3-5. Additionally, color tone was worse than in examples 3-5.

Comparative Example 3

A DMAc solution C1 (35 wt %) of 2-[2-hydroxy-3,5-bis (α,α-dimethylbenzyl)-phenyl]-2H-benzotriazole, which is a benzotriazole-based ultraviolet light absorbent that does not contain any unsaturated bonds in the molecule, was prepared.

The polymer solution P1 prepared in example 1, the aforementioned ultraviolet light absorbent solution C1 and the other additive solution B1 prepared in example 1 were homogenously mixed in amounts of 94 wt %, 3.0 wt % and 3.0 wt %, respectively, to make spinning solution E3. This spinning solution E3 was dry-spun and wound at a spinning speed of 540 m/minute with a speed ratio of the Godet roller and winder of 1.4, thereby producing 20 dtex monofilament polyurethane elastic yarn (200 g spool).

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and fracture elongation were lower than in examples 1 and 2, and permanent strain and stress relief were higher than in examples 1 and 2, and recovery characteristics were worse. Durability against light radiation and whiteness retention against light radiation were better than those in comparative example 2 and close to those in examples 1 and 2, but durability against light radiation and whiteness retention against light radiation after immersion in organic solvent were worse than in examples 1 and 2.

Comparative Example 4

A DMAc solution C1 (35 wt %) of 2-[2-hydroxy-3,5-bis (α,α-dimethylbenzyl)-phenyl]-2H-benzotriazole, which is a benzotriazole-based ultraviolet light absorbent that does not contain any unsaturated bonds in the molecule, was prepared.

The polymer solution P2 prepared in example 3, the ultraviolet light absorbent solution C1 prepared in comparative example 3 and the other additive solution B1 prepared in example 1 were homogenously mixed in amounts of 94 wt %, 3.0 wt % and 3.0 wt %, respectively, to make spinning solution E3. This spinning solution E3 was dry-spun and wound at a spinning speed of 600 m/minute with a speed ratio of the Godet roller and winder of 1.30, thereby producing 20 dtex two-filament multifilament polyurethane elastic yarn (500 g spool).

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 2. Fracture strength and fracture elongation were lower than in examples 3-8, and permanent strain and stress relief were higher than in examples 3-8, and recovery characteristics were worse. Durability against light radiation and whiteness retention against light radiation were better than those in comparative example 2 and close to those in examples 3-8, but durability against light radiation and whiteness retention against light radiation after immersion in organic solvent were worse than in examples 3-8.

TABLE 1

| | Base polymer | | Benzotriazole-based UV absorbent containing at least one unsaturated bond in molecule | | Other additives | | Benzotriazole-based UV absorbent containing no unsaturated bonds in molecule | |
|---|---|---|---|---|---|---|---|---|
| | (p1) Polyurethane polymer made up of PTMG, MDI, EG | (p2) Polyurethane urea polymer made up of PTMG, MDI, EDA | (A-1) 2-(2'-hydroxy-3'-isopropenyl-5'-t-butylphenyl)benzotriazole | (A-2) 2-(2'-hydroxy-5-methacryloxymethylphenyl)-2H-benzotriazole | (b1) Polyurethane produced by reaction oft-butyldiethanolamine and methylene-bis-(4-cyclohexylisocyanate) | (b2) Condensed polymer of p-cresol and divinylbenzene | (c1) 2-[2-hydroxy-3,5-bis(α,α-dimethylbenzyl)phenyl]-2H-benzotriazole, Tinuvin ® 234 | Total contained components (wt %) |
| Ex. 1 | 94 | 0 | 3 | 0 | 2 | 1 | 0 | 100 |
| Ex. 2 | 94 | 0 | 0 | 3 | 2 | 1 | 0 | 100 |
| Ex. 3 | 0 | 94 | 3 | 0 | 2 | 1 | 0 | 100 |
| Ex. 4 | 0 | 94 | 0 | 3 | 2 | 1 | 0 | 100 |
| Ex. 5 | 0 | 96.7 | 0 | 0.3 | 2 | 1 | 0 | 100 |
| Ex. 6 | 0 | 96.3 | 0 | 0.7 | 2 | 1 | 0 | 100 |
| Ex. 7 | 0 | 84 | 0 | 13 | 2 | 1 | 0 | 100 |
| Ex. 8 | 0 | 80 | 0 | 17 | 2 | 1 | 0 | 100 |
| Comp ex. 1 | 97 | 0 | 0 | 0 | 2 | 1 | 0 | 100 |
| Comp ex. 2 | 0 | 97 | 0 | 0 | 2 | 1 | 0 | 100 |
| Comp ex. 3 | 94 | 0 | 0 | 0 | 2 | 1 | 3 | 100 |
| Comp ex. 4 | 0 | 94 | 0 | 0 | 2 | 1 | 3 | 100 |

TABLE 2

| | Characteristics of polyurethane elastic yarn | | | | | | | | |
|---|---|---|---|---|---|---|---|---|---|
| | | | | | | | | After immersion in organic solvent | |
| | Fracture elongation (%) | Fracture strength (eN) | Permanent strain (%) | Stress relief (%) | Strength in region of actual use (eN) | Durability against light radiation (%) | Whiteness retention against light radiation | Durability against light radiation (%) | Whiteness retention against light radiation |
| Ex. 1 | 405 | 28 | 22 | 32 | 0.72 | 82 | Excellent | 76 | Excellent |
| Ex. 2 | 400 | 30 | 23 | 33 | 0.81 | 87 | Excellent | 76 | Excellent |
| Ex. 3 | 550 | 33 | 12 | 26 | 0.70 | 88 | Excellent | 81 | Excellent |
| Ex. 4 | 556 | 36 | 13 | 25 | 0.75 | 86 | Excellent | 84 | Excellent |
| Ex. 5 | 518 | 30 | 15 | 26 | 0.66 | 76 | Excellent | 68 | Good |
| Ex. 6 | 524 | 33 | 14 | 26 | 0.70 | 80 | Excellent | 78 | Excellent |
| Ex. 7 | 548 | 35 | 15 | 24 | 0.68 | 85 | Excellent | 82 | Excellent |
| Ex. 8 | 510 | 29 | 16 | 24 | 0.59 | 74 | Excellent | 70 | Good |
| Comp. ex. 1 | 387 | 20 | 27 | 37 | 0.55 | 36 | Poor | 31 | Poor |
| Comp. ex. 2 | 490 | 25 | 18 | 28 | 0.50 | 30 | Fair | 29 | Poor |
| Comp. ex. 3 | 380 | 21 | 25 | 38 | 0.55 | 78 | Excellent | 33 | Fair |
| Comp. ex. 4 | 495 | 24 | 19 | 28 | 0.49 | 75 | Excellent | 39 | Fair |

Example 9

A DMAc solution was prepared by the same method as in example 1 except that 2-hydroxy-3-allyl-5-octylbenzophenone was used as a benzophenone-based ultraviolet light absorbent containing at least one unsaturated bond in the molecule, and this was used as DMAc solution A9 (35 wt %).

The polymer solution P1 prepared in example 1, the aforementioned ultraviolet light absorbent solution A9 and the other additive solution B1 were homogenously mixed in amounts of 94 wt %, 3 wt % and 3 wt %, respectively, to make spinning solution D9.

This spinning solution was dry-spun and wound at a spinning speed of 540 m/minute with a speed ratio of the Godet roller and winder of 1.4, thereby producing 20 dtex monofilament polyurethane elastic yarn (200 g spool) in which the content of benzophenone-based ultraviolet light absorbent containing at least one unsaturated bond in the molecule was 3 wt %.

The composition (wt %) of the obtained polyurethane elastic yarn was as shown in Table 3. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 4. Fracture strength and fracture elongation were greater than in comparative example 1 (described above), which contained no benzophenone-based ultraviolet light absorbent containing at least one unsaturated bond in the molecule, and comparative example 5 (described below), which contained benzophenone-based ultraviolet light absorbent that did not contain any unsaturated bonds in the molecule. The values of permanent strain and stress relief were lower than in comparative example 1 and comparative example 5, and recovery characteristics were better. Durability against light radiation and durability against light radiation after immersion in organic solvent were more than twice as high as in comparative example 1. Durability against light radiation and durability against light radiation after immersion in organic solvent were at least twice as high as in comparative examples 1 and 5. Whiteness retention against light radiation and whiteness retention against light radiation after immersion in organic solvent were both greatly improved compared to comparative example 1, and although it was the same as in comparative example 5 before immersion in organic solvent, it was better after immersion in organic solvent.

Example 10

A DMAc solution was prepared by the same method as in example 1 except that 2-hydroxy-5-methacryloxyethylbenzophenone (the compound of Formula 5) was used as a benzophenone-based ultraviolet light absorbent containing at least one unsaturated bond in the molecule, and this was used as DMAc solution A10 (35 wt %).

The polymer solution P1 prepared in example 1, the aforementioned ultraviolet light absorbent solution A10 and the other additive solution B1 were homogenously mixed in amounts of 94 wt %, 3 wt % and 3 wt %, respectively, to make spinning solution D2.

This spinning solution was dry-spun and wound at a spinning speed of 540 m/minute with a speed ratio of the Godet roller and winder of 1.4, thereby producing 20 dtex monofilament polyurethane elastic yarn (200 g spool) in which the content of benzophenone-based ultraviolet light absorbent containing at least one unsaturated bond in the molecule was 3 wt %.

The composition (wt %) of the obtained polyurethane elastic yarn was as shown in Table 3. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 4. Fracture strength and fracture elongation were greater than in comparative example 1 (described above), which contained no benzophenone-based ultraviolet light absorbent containing at least one unsaturated bond in the molecule, and comparative example 5 (described below), which contained benzophenone-based ultraviolet light absorbent that did not contain any unsaturated bonds in the molecule. The values of permanent strain and stress relief were lower than in comparative example 1 and comparative example 5, and recovery characteristics were better. Durability against light radiation and durability against light radiation after immersion in organic solvent were at least twice as high as in comparative examples 1 and 5. Whiteness retention against light radiation and whiteness retention against light radiation after immersion in organic solvent were both greatly improved compared to comparative example 1, and although it was the same as in comparative example 5 before immersion in organic solvent, it was better after immersion in organic solvent.

Example 11

The polymer solution P2 prepared in example 3, the ultraviolet light absorbent solution A9 prepared in example 9 and the other additive solution B1 prepared in example 1 were homogenously mixed in amounts of 94 wt %, 3.0 wt % and 3.0 wt %, respectively, to make spinning solution D11. This spinning solution D11 was dry-spun and wound at a spinning speed of 600 m/minute with a speed ratio of the Godet roller and winder of 1.20, thereby producing 20 dtex monofilament polyurethane elastic yarn (500 g spool) in which the content of benzophenone-based ultraviolet light absorbent containing at least one unsaturated bond in the molecule was 3 wt %.

The composition (wt %) of the obtained polyurethane elastic yarn was as shown in Table 3. The fracture elongation, fracture strength, strength in region of actual use, permanent strain, stress relief durability against light radiation, whiteness retention against light radiation, durability against light radiation after immersion in organic solvent and whiteness retention against light radiation after immersion in organic solvent of this polyurethane elastic yarn are shown in Table 4. Fracture strength and elongation were greater than in comparative example 2, which contained no benzophenone-based ultraviolet light absorbent containing at least one unsaturated bond in the molecule, and comparative example 6 (described below), which contained benzophenone-based ultraviolet light absorbent that did not contain any unsaturated bonds in the molecule. The values of permanent strain and stress relief were lower than in comparative example 2 and comparative example 6, and recovery characteristics were better. Durability against light radiation and durability against light radiation after immersion in organic solvent were more than twice as high as in comparative example 2. Compared to comparative example 6, durability against light radiation before immersion in organic solvent was 1.5 times higher, and durability after immersion in organic solvent was more than twice as high. Whiteness retention against light radiation and whiteness retention against light radiation after immersion in organic solvent were both greatly improved compared to comparative example 2, and improvement was also seen compared to comparative example 6.

Example 12

The polymer solution P2 prepared in example 3, the ultraviolet light absorbent solution A10 prepared in example 10 and the other additive solution B1 prepared in example 1 were homogenously mixed in amounts of 94.0 wt %, 3.0 wt % and 3.0 wt %, respectively, to make spinning solution D12. This spinning solution D12 was dry-spun and wound at a spinning speed of 600 m/minute with a speed ratio of the Godet roller and winder of 1.30, thereby producing 20 dtex two-filament multifilament polyurethane elastic yarn (500 g spool) in which the content of benzophenone-based ultraviolet light absorbent containing at least one unsaturated bond in the molecule was 3 wt %.

The composition (wt %) of the obtained polyurethane elastic yarn was as shown in Table 3.

The fracture elongation, fracture strength, strength in region of actual use, permanent strain, stress relief durability against light radiation, whiteness retention against light radiation, durability against light radiation after immersion in organic solvent and whiteness retention against light radiation after immersion in organic solvent of this polyurethane elastic yarn are shown in Table 4. Fracture strength and elongation were greater than in comparative example 2, which contained no benzophenone-based ultraviolet light absorbent containing at least one unsaturated bond in the molecule, and comparative example 6 (described below), which contained benzophenone-based ultraviolet light absorbent that did not contain any unsaturated bonds in the molecule. The values of permanent strain and stress relief were lower than in comparative example 2 and comparative example 6, and recovery characteristics were better. Durability against light radiation and durability against light radiation after immersion in organic solvent were more than twice as high as in comparative example 2. Compared to comparative example 6, durability against light radiation before immersion in organic solvent was about 40% higher, but durability after immersion in organic solvent was more than twice as high. Whiteness retention against light radiation and whiteness retention against light radiation after immersion in organic solvent were both greatly improved compared to comparative example 2, and improvement was also seen compared to comparative example 6.

Example 13

The polymer solution P2 prepared in example 3, the ultraviolet light absorbent solution A10 prepared in example 10 and the other additive solution B1 prepared in example 1 were homogenously mixed in amounts of 96.7 wt %, 0.3 wt % and 3.0 wt %, respectively, to make spinning solution D5.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 3. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 4. Fracture strength and elongation were greater than in comparative example 2, which contained no benzophenone-based ultraviolet light absorbent containing at least one unsaturated bond in the molecule, and comparative example 6 (described below), which contained benzophenone-based ultraviolet light absorbent that did not contain any unsaturated bonds in the molecule. The values of permanent strain and stress relief were lower than in comparative example 2 and comparative example 6, and recovery characteristics were better. Durability against light radiation and durability against light radiation after immersion in organic solvent were more than twice as high as in comparative example 2. Compared to comparative example 4, durability against light radiation before immersion in organic solvent was about 15% higher, but durability after immersion in organic solvent was twice as high. Whiteness retention against light radiation and whiteness retention against light radiation after immersion in organic solvent were both greatly improved compared to comparative example 2, and improvement was also seen compared to comparative example 6.

Example 14

The polymer solution P2 prepared in example 3, the ultraviolet light absorbent solution A10 prepared in example 10 and the other additive solution B1 prepared in example 1 were homogenously mixed in amounts of 96.3 wt %, 0.7 wt % and 3.0 wt %, respectively, to make spinning solution D14.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 3. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 4. Fracture strength and elongation were greater than in comparative example 2, which contained no benzophenone-based ultraviolet light absorbent containing at least one unsaturated bond in the molecule, and comparative example 6 (described below), which contained benzophenone-based ultraviolet light absorbent that did not contain any unsaturated bonds in the molecule. The values of permanent strain and stress relief were lower than in comparative example 2 and comparative example 6, and recovery characteristics were better. Durability against light radiation and durability against light radiation after immersion in organic solvent were more than twice as high as in comparative example 2. Compared to comparative example 6, durability against light radiation before immersion in organic solvent was about 17% higher, but durability after immersion in organic solvent was more than twice as high. Whiteness retention against light radiation and whiteness retention against light radiation after immersion in organic solvent were both greatly improved compared to comparative example 2, and improvement was also seen compared to comparative example 6.

Example 15

The polymer solution P2 prepared in example 3, the ultraviolet light absorbent solution A10 prepared in example 10 and the other additive solution B1 prepared in example 1 were homogenously mixed in amounts of 84.0 wt %, 13.0 wt % and 3.0 wt %, respectively, to make spinning solution D15.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 3. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 4. Fracture strength and elongation were greater than in comparative example 2, which contained no benzophenone-based ultraviolet light absorbent containing at least one unsaturated bond in the molecule, and comparative example 6 (described below), which contained benzophenone-based ultraviolet light absorbent that did not contain any unsaturated bonds in the molecule. The values of permanent strain and stress relief were lower than in comparative example 2 and comparative example 6, and recovery characteristics were better. Durability against light radiation and durability against light radiation after immersion in organic solvent were approximately three times higher than in comparative example 2, and compared to comparative example 6, they were 1.5 times and 2.6 times higher, respectively. Whiteness retention against light radiation and whiteness retention against light radiation after immersion in organic solvent were both greatly improved compared to comparative example 2, and improvement was also seen compared to comparative example 6.

Example 16

The polymer solution P2 prepared in example 3, the ultraviolet light absorbent solution A10 prepared in example 10 and the other additive solution B1 prepared in example 1 were homogenously mixed in amounts of 80.0 wt %, 17.0 wt % and 3.0 wt %, respectively, to make spinning solution D16.

This spinning solution D16 was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 3. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 4. Fracture strength and elongation were greater than in comparative example 2, which contained no benzophenone-based ultraviolet light absorbent containing at least one unsaturated bond in the molecule, and comparative example 6 (described below), which contained benzophenone-based ultraviolet light absorbent that did not contain any unsaturated bonds in the molecule. The values of permanent strain and stress relief were lower than in comparative example 2 and comparative example 4, and recovery characteristics were better. Durability against light radiation and durability against light radiation after immersion in organic solvent were more than three times higher than in comparative example 2, and compared to comparative example 6, they were approximately 1.5 times and approximately 2.7 times higher, respectively. Whiteness retention against light radiation and whiteness retention against light radiation after immersion in organic solvent were both greatly improved compared to comparative example 2, and improvement was also seen compared to comparative example 6.

Comparative Example 5

A DMAc solution C1 (35 wt %) of 2,4-dihydroxybenzophenone, which is a benzophenone-based ultraviolet light absorbent that does not contain any unsaturated bonds in the molecule, was prepared.

The polymer solution P1 prepared in example 1, the aforementioned ultraviolet light absorbent solution C1 and the other additive solution B1 prepared in example 1 were homogenously mixed in amounts of 94 wt %, 3.0 wt % and 3.0 wt %, respectively, to make spinning solution E3. This spinning solution E3 was dry-spun and wound at a spinning speed of 540 m/minute with a speed ratio of the Godet roller and winder of 1.4, thereby producing 20 dtex monofilament polyurethane elastic yarn (200 g spool).

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 4.

Comparative Example 6

A DMAc solution C1 (35 wt %) of 2A-dihydroxybenzophenone, which is a benzophenone-based ultraviolet light absorbent that does not contain any unsaturated bonds in the molecule, was prepared.

The polymer solution P2 prepared in example 3, the aforementioned ultraviolet light absorbent solution C1 and the other additive solution B1 prepared in example 1 were homogenously mixed in amounts of 94 wt %, 3.0 wt % and 3.0 wt %, respectively, to make spinning solution E3. This spinning solution E3 was dry-spun and wound at a spinning speed of 600 m/minute with a speed ratio of the Godet roller and winder of 1.30, thereby producing 20 dtex two-filament multifilament polyurethane elastic yarn (500 g spool).

The fracture elongation, fracture strength, strength in region of actual use, permanent strain, stress relief durability against light radiation, whiteness retention against light radiation, durability against light radiation after immersion in organic solvent and whiteness retention against light radiation after immersion in organic solvent of this polyurethane elastic yarn are shown in Table 4.

TABLE 3

| | Base polymer | | Benzophenone-based UV absorbent containing at least one unsaturated bond in molecule | | Other additives | | Benzophenone-based UV absorbent containing no unsaturated bonds in molecule | |
|---|---|---|---|---|---|---|---|---|
| | (p1) Polyurethane polymer made up of PTMG, MDI, EG | (p2) Polyurethane urea polymer made up of PTMG, MDI, EDA | {A'-1) 2-hydroxy-3-allyl-5-octyl-benzophenone | (A'-2) 2-hydroxy-5-methacryloxyethyl benzophenone | (b1) Polyurethane produced by reaction oft-butyldiethanolamine and methylene-bis-(4-cyclohexyl isocyanate) | (b2) Condensed polymer of p-cresol and divinylbenzene | (c1) 2,4-dihydroxy benzophenone, Lowilite ® 24 | Total contained components (wt %) |
| Ex. 9 | 94 | 0 | 3 | 0 | 2 | 1 | 0 | 100 |
| Ex. 10 | 94 | 0 | 0 | 3 | 2 | 1 | 0 | 100 |
| Ex. 11 | 0 | 94 | 3 | 0 | 2 | 1 | 0 | 100 |
| Ex. 12 | 0 | 94 | 0 | 3 | 2 | 1 | 0 | 100 |

TABLE 3-continued

| | Base polymer | | Benzophenone-based UV absorbent containing at least one unsaturated bond in molecule | | Other additives | | Benzophenone-based UV absorbent containing no unsaturated bonds in molecule | |
|---|---|---|---|---|---|---|---|---|
| | (p1) Polyurethane polymer made up of PTMG, MDI, EG | (p2) Polyurethane urea polymer made up of PTMG, MDI, EDA | {A'-1) 2-hydroxy-3-allyl-5-octyl-benzophenone | (A'-2) 2-hydroxy-5-methacryloxyethyl benzophenone | (b1) Polyurethane produced by reaction oft-butyldiethanolamine and methylene-bis-(4-cyclohexyl isocyanate) | (b2) Condensed polymer of p-cresol and divinylbenzene | (c1) 2,4-dihydroxy benzophenone, Lowilite ® 24 | Total contained components (wt %) |
| Ex. 13 | 0 | 96.7 | 0 | 0.3 | 2 | 1 | 0 | 100 |
| Ex. 14 | 0 | 96.3 | 0 | 0.7 | 2 | 1 | 0 | 100 |
| Ex. 15 | 0 | 84 | 0 | 13 | 2 | 1 | 0 | 100 |
| Ex. 16 | 0 | 80 | 0 | 17 | 2 | 1 | 0 | 100 |
| Comp. ex. 1 | 97 | 0 | 0 | 0 | 2 | 1 | 0 | 100 |
| Comp. ex. 2 | 0 | 97 | 0 | 0 | 2 | 1 | 0 | 100 |
| Comp. ex. 5 | 94 | 0 | 0 | 0 | 2 | 1 | 3 | 100 |
| Comp. ex. 6 | 0 | 94 | 0 | 0 | 2 | 1 | 3 | 100 |

TABLE 4

| | Characteristics of polyurethane elastic yarn | | | | | | | | |
|---|---|---|---|---|---|---|---|---|---|
| | | | | | Strength in | | | After immersion in organic solvent | |
| | Fracture elongation (%) | Fracture strength (eN) | Permanent strain (%) | Stress relief (%) | region of actual use (eN) | Durability against light radiation (%) | Whiteness retention against light radiation | Durability against light radiation (%) | Whiteness retention against light radiation |
| Ex. 9 | 415 | 27 | 21 | 31 | 0.70 | 80 | Excellent | 80 | Excellent |
| Ex. 10 | 405 | 32 | 22 | 34 | 0.83 | 79 | Excellent | 80 | Excellent |
| Ex. 11 | 570 | 35 | 12 | 25 | 0.79 | 90 | Excellent | 87 | Excellent |
| Ex. 12 | 610 | 39 | 11 | 22 | 0.84 | 85 | Excellent | 85 | Excellent |
| Ex. 13 | 530 | 31 | 15 | 25 | 0.76 | 69 | Excellent | 66 | Excellent |
| Ex. 14 | 525 | 32 | 15 | 26 | 0.77 | 70 | Excellent | 71 | Excellent |
| Ex. 15 | 530 | 33 | 14 | 26 | 0.73 | 91 | Excellent | 86 | Excellent |
| Ex. 16 | 535 | 30 | 16 | 27 | 0.70 | 92 | Excellent | 90 | Excellent |
| Comp. ex. 1 | 387 | 20 | 27 | 37 | 0.55 | 36 | Poor | 31 | Poor |
| Comp. ex. 2 | 490 | 25 | 18 | 28 | 0.50 | 30 | Fair | 29 | Poor |
| Comp. ex. 5 | 350 | 18 | 25 | 37 | 0.51 | 42 | Excellent | 32 | Good |
| Comp. ex. 6 | 470 | 24 | 19 | 28 | 0.50 | 60 | Good | 33 | Good |

Example 17

A DMAc solution was prepared by the same method as in example 1 except that 2-(2'-hydroxy-4'-octyloxyphenyl)benzotriazole was used as a benzotriazole-based ultraviolet light absorbent containing at least one alkoxy group: B1 in the molecule (number of carbons in alkoxy group: B), and this was used as DMAc solution A17 (35 wt %).

The polymer solution P1 prepared in example 1, the aforementioned ultraviolet light absorbent solution A17 and the other additive solution B1 were homogenously mixed in amounts of 94 wt %, 3 wt % and 3 wt %, respectively, to make spinning solution D17. This spinning solution was dry-spun and wound at a spinning speed of 540 m/minute with a speed ratio of the Godet roller and winder of 1.4, thereby producing 20 dtex monofilament polyurethane elastic yarn (200 g spool) in which the content of benzotriazole-based ultraviolet light absorbent containing at least one alkoxy group in the molecule was 3 wt %.

The composition (wt %) of the obtained polyurethane elastic yarn was as shown in Table 5. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6. Fracture strength and fracture elongation were greater than in comparative example 1 (described above), which contained no benzotriazole-based ultraviolet light absorbent containing at least one alkoxy group in the molecule, and comparative example 7 (described below), which contained benzotriazole-based ultraviolet light absorbent that did not contain any unsaturated bonds in the molecule. The values of permanent strain and stress relief were lower than in comparative example 1 and comparative example 7, and recovery characteristics were better. Durability against light radiation and durability against light radiation after immersion in organic solvent were more than twice as high as in comparative example 1. Compared to comparative example 7, durability against light radiation before immersion in organic solvent was the same, but durability after immersion in organic solvent was more than twice as high. Whiteness retention against light radiation and whiteness retention against light radiation after immersion in organic solvent were both greatly improved compared to comparative example 1, and whiteness retention was much better than in comparative example 7 after immersion in organic solvent.

Example 18

A DMAc solution was prepared by the same method as in example 1 except that 2-(2'-hydroxy-4'-octyloxyphenyl)-5-chloro-benzotriazole was used as a benzotriazole-based ultraviolet light absorbent containing at least one alkoxy group in the molecule (number of carbons in alkoxy group: 18), and this was used as DMAc solution A18 (35 wt %).

The polymer solution prepared in example 1, the aforementioned ultraviolet light absorbent solution A18 and the other additive solution B1 were homogenously mixed in amounts of 94 wt %, 3 wt % and 3 wt %, respectively, to make spinning solution D2.

This spinning solution was dry-spun and wound at a spinning speed of 540 m/minute with a speed ratio of the Godet roller and winder of 1.4, thereby producing 20 dtex monofilament polyurethane elastic yarn (200 g spool) in which the content of benzotriazole-based ultraviolet light absorbent containing at least one alkoxy group in the molecule was 3 wt %.

The composition (wt %) of the obtained polyurethane elastic yarn was as shown in Table 5. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6. Fracture strength and fracture elongation were greater than in comparative example 1 (described above), which contained no benzotriazole-based ultraviolet light absorbent containing at least one alkoxy group in the molecule, and comparative example 7 (described below), which contained benzotriazole-based ultraviolet light absorbent that did not contain any alkoxy groups in the molecule. The values of permanent strain and stress relief were lower than in comparative example 1 and comparative example 7, and recovery characteristics were better. Durability against light radiation and durability against light radiation after immersion in organic solvent were more than twice as high as in comparative example 1. Compared to comparative example 7, durability against light radiation before immersion in organic solvent was about 1.2 times higher, but durability after immersion in organic solvent was more than twice as high. Whiteness retention against light radiation and whiteness retention against light radiation after immersion in organic solvent were both greatly improved compared to comparative example 1, and whiteness retention was much better than in comparative example 7 after immersion in organic solvent.

Example 19

The polymer solution P2 prepared in example 3, the ultraviolet light absorbent solution A17 prepared in example 17 and the other additive solution B1 prepared in example 1 were homogenously mixed in amounts of 94.0 wt %, 3.0 wt % and 3.0 wt %, respectively, to make spinning solution D19. This spinning solution D19 was dry-spun and wound at a spinning speed of 600 m/minute with a speed ratio of the Godet roller and winder of 1.20, thereby producing 20 dtex monofilament polyurethane elastic yarn (500 g spool) in which the content of benzotriazole-based ultraviolet light absorbent containing at least one alkoxy group in the molecule was 3 wt %.

The composition (wt %) of the obtained polyurethane elastic yarn was as shown in Table 5. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6. Fracture strength and elongation were greater than in comparative example 2 (described above), which contained no benzotriazole-based ultraviolet light absorbent containing at least one alkoxy group in the molecule, and comparative example 8 (described below), which contained benzotriazole-based ultraviolet light absorbent that did not contain any alkoxy groups in the molecule. The values of permanent strain and stress relief were lower than in comparative example 2 and comparative example 8, and recovery characteristics were better. Durability against light radiation and durability against light radiation after immersion in organic solvent were more than twice as high as in comparative example 2. Compared to comparative example 8, durability against light radiation before immersion in organic solvent was the same, but durability after immersion in organic solvent was more than twice as high. Whiteness retention against light radiation and whiteness retention against light radiation after immersion in organic solvent were both greatly improved compared to comparative example 2, and whiteness retention was much better than in comparative example 8 after immersion in organic solvent.

Example 20

The polymer solution P2 prepared in example 3, the ultraviolet light absorbent solution A18 prepared in example 18 and the other additive solution B1 prepared in example were homogenously mixed in amounts of 94.0 wt %, 3.0 wt % and 3.0 wt %, respectively, to make spinning solution D20. This spinning solution D20 was dry-spun and wound at a spinning speed of 600 m/minute with a speed ratio of the Godet roller and winder of 1.30, thereby producing 20 dtex two-filament multifilament polyurethane elastic yarn (500 g spool) in which the content of benzotriazole-based ultraviolet light absorbent containing at least one alkoxy group in the molecule was 3 wt %.

The composition (wt %) of the obtained polyurethane elastic yarn was as shown in Table 5.

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6. Fracture strength and elongation were greater than in comparative example 2, which contained no benzotriazole-based ultraviolet light absorbent containing at least one alkoxy group in the molecule, and comparative example 8 (described below), which contained benzotriazole-based ultraviolet light absorbent that did not contain any alkoxy groups in the molecule. The values of permanent strain and stress relief were lower than in comparative example 2 and comparative example 8, and recovery characteristics were better. Durability against light radiation and durability against light radiation after immersion in organic solvent were more than twice as high as in comparative example 2. Compared to comparative example 8, durability against light radiation before immersion in organic solvent was the same, but durability after immersion in organic solvent was more than twice as high. Whiteness retention against light radiation and whiteness retention against light radiation after immersion in organic solvent were both greatly improved compared to comparative example 2, and whiteness retention was much better than in comparative example 8 after immersion in organic solvent.

Example 21

The polymer solution P2 prepared in example 3, the ultraviolet light absorbent solution A18 prepared in example 18 and the other additive solution B1 prepared in example were homogenously mixed in amounts of 96.7 wt %, 0.3 wt % and 3.0 wt %, respectively, to make spinning solution D21.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 5. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6. Fracture strength and elongation were greater than in comparative example 2, which contained no benzotriazole-based ultraviolet light absorbent containing at least one alkoxy group in the molecule, and comparative example 8 (described below), which contained benzotriazole-based ultraviolet light absorbent that did not contain any alkoxy groups in the molecule. The values of permanent strain and stress relief were lower than in comparative example 2 and comparative example 8, and recovery characteristics were better. Durability against light radiation and durability against light radiation after immersion in organic solvent were more than twice as high as in comparative example 2. Compared to comparative example 8, durability against light radiation before immersion in organic solvent was the same, but durability after immersion in organic solvent was more than twice as high. Whiteness retention against light radiation and whiteness retention against light radiation after immersion in organic solvent were both greatly improved compared to comparative example 2, and whiteness retention was much better than in comparative example 8 after immersion in organic solvent.

Example 22

The polymer solution P2 prepared in example 3, the ultraviolet light absorbent solution A18 prepared in example 18 and the other additive solution B1 prepared in example 1 were homogenously mixed in amounts of 96.3 wt %, 0.7 wt % and 3.0 wt %, respectively, to make spinning solution D22.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 5. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6. Fracture strength and elongation were greater than in comparative example 2, which contained no benzotriazole-based ultraviolet light absorbent containing at least one alkoxy group in the molecule, and comparative example 8 (described below), which contained benzotriazole-based ultraviolet light absorbent that did not contain any alkoxy groups in the molecule. The values of permanent strain and stress relief were lower than in comparative example 2 and comparative example 8, and recovery characteristics were better. Durability against light radiation and durability against light radiation after immersion in organic solvent were more than twice as high as in comparative example 2. Compared to comparative example 8, durability against light radiation before immersion in organic solvent was the same, but durability after immersion in organic solvent was more than twice as high. Whiteness retention against light radiation and whiteness retention against light radiation after immersion in organic solvent were both greatly improved compared to comparative example 2, and whiteness retention was much better than in comparative example 8 after immersion in organic solvent.

Example 23

The polymer solution P2 prepared in example 3, the ultraviolet light absorbent solution A18 prepared in example 18 and the other additive solution B1 prepared in example 1 were homogenously mixed in amounts of 84.0 wt %, 13.0 wt % and 3.0 wt %, respectively, to make spinning solution D23.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 5. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6. Fracture strength and elongation were greater than in comparative example 2, which contained no benzotriazole-based ultraviolet light absorbent containing at least one alkoxy group in the molecule, and comparative example 8 (described below), which contained benzotriazole-based ultraviolet light absorbent that did not contain any alkoxy groups in the molecule. The values of permanent strain and stress relief were lower than in comparative example 2 and comparative example 8, and recovery characteristics were better. Durability against light radiation and durability against light radiation after immersion in organic solvent were more than approximately 2.8 times higher than in comparative example 2. Compared to comparative example 8, durability against light radiation before immersion in organic solvent was about 1.2 times higher, and durability after immersion in organic solvent was more than twice as high. Whiteness retention against light radiation and whiteness retention against light radiation after immersion in organic solvent were both greatly improved compared to comparative example 2, and whiteness retention was much better than in comparative example 8 after immersion in organic solvent.

Example 24

The polymer solution P2 prepared in example 3, the ultraviolet light absorbent solution A18 prepared in example 18 and the other additive solution B1 prepared in example 1 were homogenously mixed in amounts of 80.0 wt %, 17.0 wt % and 3.0 wt %, respectively, to make spinning solution D24.

This spinning solution D24 was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 5. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6. Fracture strength and elongation were greater than in comparative example 2, which contained no benzotriazole-based ultraviolet light absorbent containing at least one alkoxy group in the molecule, and comparative example 8 (described below), which contained benzotriazole-based ultraviolet light absorbent that did not contain any alkoxy groups in the molecule. The values of permanent strain and stress relief were lower than in comparative example 2 and comparative example 8, and recovery characteristics were better. Durability against light radiation and durability against light radiation after immersion in organic solvent were more than three times higher than in comparative example 2. Compared to comparative example 8, durability against light radiation before immersion in organic solvent was about 1.2 times higher, and durability after immersion in organic solvent was approximately 2.7 times higher. Whiteness retention against light radiation and whiteness retention against light radiation after immersion in organic solvent were both improved compared to comparative example 2 and comparative example 4, both before immersion in organic solvent and after immersion in organic solvent.

Comparative Example 7

A DMAc solution C7 (35 wt %) of 2-(2'-hydroxy-4'-t-octylphenyl)benzotriazole, which is a benzotriazole-based ultraviolet light absorbent that does not contain any alkoxy groups in the molecule, was prepared.

The polymer solution P1 prepared in example 1, the aforementioned ultraviolet light absorbent solution C7 and the other additive solution B1 prepared in example 1 were homogenously mixed in amounts of 94 wt %, 3.0 wt % and 3.0 wt %, respectively, to make spinning solution E7. This spinning solution E7 was dry-spun and wound at a spinning speed of 540 m/minute with a speed ratio of the Godet roller and winder of 1.4, thereby producing 20 dtex monofilament polyurethane elastic yarn (200 g spool).

The fracture elongation, fracture strength, strength in region of actual use, permanent strain, stress relief durability against light radiation, whiteness retention against light radiation, durability against light radiation after immersion in organic solvent and whiteness retention against light radiation after immersion in organic solvent of this polyurethane elastic yarn are shown in Table 6.

Comparative Example 8

The polymer solution P2 prepared in example 3, the ultraviolet light absorbent solution C7 prepared in example 3 and the other additive solution B1 prepared in example 1 were homogenously mixed in amounts of 94 wt %, 3.0 wt % and 3.0 wt %, respectively, to make spinning solution E8. This spinning solution E8 was dry-spun and wound at a spinning speed of 600 m/minute with a speed ratio of the Godet roller and winder of 1.30, thereby producing 20 dtex two-filament multifilament polyurethane elastic yarn (500 g spool).

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 6.

TABLE 5

| | Base polymer | | Benzotriazole-based UV absorbent containing at least one alkoxy group in molecule | | Other additives | | Benzotriazole-based UV absorbent containing no alkoxy groups in molecule | |
|---|---|---|---|---|---|---|---|---|
| | (p1) Polyurethane polymer made up of PTMG, MDI, EG | (p2) Polyurethane urea polymer made up of PTMG, MDI, EDA | (B-1) 2-(2'-hydroxy-4'-octyloxy-phenyl)benzo-triazole | (B-2) 2-(2'-hydroxy-4'-octadecyl-oxyphenyl)-5-chloro-benzotriazole | (b1) Polyurethane produced by reaction oft-butyl-diethanolamine and methylene-bis-(4-cyclohexyl isocyanate) | (b2) Condensed polymer of p-cresol and divinylbenzene | (c1) 2-(2'-hydroxy-4'-t-octylphenyl)benzo-triazole Tinuvin ® 329 | Total contained components (wt %) |
| Ex. 17 | 94 | 0 | 3 | 0 | 2 | 1 | 0 | 100 |
| Ex. 18 | 94 | 0 | 0 | 3 | 2 | 1 | 0 | 100 |
| Ex. 19 | 0 | 94 | 3 | 0 | 2 | 1 | 0 | 100 |
| Ex. 20 | 0 | 94 | 0 | 3 | 2 | 1 | 0 | 100 |
| Ex. 21 | 0 | 96.7 | 0 | 0.3 | 2 | 1 | 0 | 100 |
| Ex. 22 | 0 | 96.3 | 0 | 0.7 | 2 | 1 | 0 | 100 |
| Ex. 23 | 0 | 84 | 0 | 13 | 2 | 1 | 0 | 100 |
| Ex. 24 | 0 | 80 | 0 | 17 | 2 | 1 | 0 | 100 |

TABLE 5-continued

| | Base polymer | | Benzotriazole-based UV absorbent containing at least one alkoxy group in molecule | | Other additives | | Benzotriazole-based UV absorbent containing no alkoxy groups in molecule | |
|---|---|---|---|---|---|---|---|---|
| | (p1) Polyurethane polymer made up of PTMG, MDI, EG | (p2) Polyurethane urea polymer made up of PTMG, MDI, EDA | (B-1) 2-(2'-hydroxy-4'-octyloxy-phenyl)benzo-triazole | (B-2) 2-(2'-hydroxy-4'-octadecyl-oxyphenyl)-5-chloro-benzotriazole | (b1) Polyurethane produced by reaction oft-butyl-diethanolamine and methylene-bis-(4-cyclohexyl isocyanate) | (b2) Condensed polymer of p-cresol and divinylbenzene | (c1) 2-(2'-hydroxy-4'-t-octylphenyl)benzo-triazole Tinuvin ® 329 | Total contained components (wt %) |
| Comp. ex. 1 | 97 | 0 | 0 | 0 | 2 | 1 | 0 | 100 |
| Comp. ex. 2 | 0 | 97 | 0 | 0 | 2 | 1 | 0 | 100 |
| Comp. ex. 7 | 94 | 0 | 0 | 0 | 2 | 1 | 3 | 100 |
| Comp. ex. 8 | 0 | 94 | 0 | 0 | 2 | 1 | 3 | 100 |

TABLE 6

| | Characteristics of polyurethane elastic yarn | | | | | | | | |
|---|---|---|---|---|---|---|---|---|---|
| | | | | | Strength in | | | After immersion in organic solvent | |
| | Fracture elongation (%) | Fracture strength (eN) | Permanent strain (%) | Stress relief (%) | region of actual use (eN) | Durability against light radiation (%) | Whiteness retention against light radiation | Durability against light radiation (%) | Whiteness retention against light radiation |
| Ex. 17 | 440 | 30 | 19 | 29 | 0.80 | 77 | Excellent | 78 | Excellent |
| Ex. 18 | 445 | 30 | 20 | 29 | 0.84 | 82 | Excellent | 82 | Excellent |
| Ex. 19 | 600 | 32 | 10 | 24 | 0.81 | 85 | Excellent | 83 | Excellent |
| Ex. 20 | 620 | 33 | 9 | 24 | 0.85 | 81 | Excellent | 81 | Excellent |
| Ex. 21 | 565 | 30 | 13 | 24 | 0.72 | 82 | Excellent | 80 | Excellent |
| Ex. 22 | 620 | 31 | 10 | 24 | 0.79 | 84 | Excellent | 81 | Excellent |
| Ex. 23 | 630 | 30 | 15 | 26 | 0.73 | 90 | Excellent | 89 | Excellent |
| Ex. 24 | 605 | 29 | 16 | 25 | 0.68 | 92 | Good | 93 | Good |
| Comp. ex. 1 | 387 | 20 | 27 | 37 | 0.55 | 36 | Poor | 31 | Poor |
| Comp. ex. 2 | 490 | 25 | 18 | 28 | 0.50 | 30 | Fair | 29 | Poor |
| Comp. ex. 7 | 390 | 20 | 27 | 38 | 0.55 | 70 | Good | 36 | Fair |
| Comp. ex. 8 | 495 | 24 | 19 | 28 | 0.60 | 78 | Fair | 34 | Fair |

Example 25

A DMAc solution was prepared by the same method as in example 1 except that 2,4-dihydroxy-benzophenonesulfonic acid was used as a benzophenone-based ultraviolet light absorbent containing at least one sulfonic acid group in the molecule, and this was used as DMAc solution A25 (35 wt %).

The polymer solution P1 prepared in example 1, the aforementioned ultraviolet light absorbent solution A25 and the other additive solution B1 were homogenously mixed in amounts of 94 wt %, 3 wt % and 3 wt %, respectively, to make spinning solution D25. This spinning solution was dry-spun and wound at a spinning speed of 540 m/minute with a speed ratio of the Godet roller and winder of 1.4, thereby producing 20 dtex monofilament polyurethane elastic yarn (200 g spool) in which the content of benzophenone-based ultraviolet light absorbent containing at least one sulfonic acid group in the molecule was 3 wt %.

The composition (wt %) of the obtained polyurethane elastic yarn was as shown in Table 7. The fracture elongation, fracture strength, strength in region of actual use, permanent strain, stress relief durability against light radiation, whiteness retention against light radiation, durability against light radiation after immersion in organic solvent and whiteness retention against light radiation after immersion in organic solvent of this polyurethane elastic yarn are shown in Table 8. Fracture strength and fracture elongation were greater than in comparative example 1 (described above) which contained no benzophenone-based ultraviolet light absorbent containing at least one sulfonic acid group in the molecule, and comparative example 9 (described below), which contained benzophenone-based ultraviolet light absorbent that did not contain any sulfonic acid groups in the molecule. The values of permanent strain and stress relief were lower than in comparative example 1 and comparative example 9, and recovery characteristics were better. Durability against light radiation and durability against light radiation after immersion in organic solvent were more than twice as high as in comparative example 1. Compared to comparative example 9, durability against light radiation before immersion in organic solvent was the same, but durability after immersion in organic solvent was more than twice as high. Whiteness retention against light radiation and whiteness retention against light radiation after immersion in organic solvent were both greatly improved compared to comparative example 1, and whiteness retention was much better than in comparative example 9 after immersion in organic solvent.

Example 26

A DMAc solution was prepared by the same method as in example 1 except that 2-hydroxy-4-methoxybenzophenone-5-sulfonic acid was used as a benzophenone-based ultraviolet light absorbent containing at least one sulfonic acid group in the molecule, and this was used as DMAc solution A26 (35 wt %).

The polymer solution P1 prepared in example 1, the aforementioned ultraviolet light absorbent solution A26 and the other additive solution B1 were homogenously mixed in amounts of 94 wt %, 3 wt % and 3 wt %, respectively, to make spinning solution D2.

This spinning solution was dry-spun and wound at a spinning speed of 540 m/minute with a speed ratio of the Godet roller and winder of 1.4, thereby producing 20 dtex monofilament polyurethane elastic yarn (200 g spool) in which the content of benzophenone-based ultraviolet light absorbent containing at least one sulfonic acid group in the molecule was 3 wt %.

The composition (wt %) of the obtained polyurethane elastic yarn was as shown in Table 7. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 8. Fracture strength and fracture elongation were greater than in comparative example 1 (described above), which contained no benzophenone-based ultraviolet light absorbent containing at least one sulfonic acid group in the molecule, and comparative example 9 (described below), which contained benzophenone-based ultraviolet light absorbent that did not contain any sulfonic acid groups in the molecule. The values of permanent strain and stress relief were lower than in comparative example 1 and comparative example 9, and recovery characteristics were better. Durability against light radiation and durability against light radiation after immersion in organic solvent were more than twice as high as in comparative example 1. Compared to comparative example 9, durability against light radiation before immersion in organic solvent was the same, but durability after immersion in organic solvent was more than twice as high. Whiteness retention against light radiation and whiteness retention against light radiation after immersion in organic solvent were both greatly improved compared to comparative example 1, and whiteness retention was much better than in comparative example 9 after immersion in organic solvent.

Example 27

The polymer solution P2 prepared in example 3, the ultraviolet light absorbent solution A25 prepared in example 25 and the other additive solution B1 prepared in example were homogenously mixed in amounts of 94.0 wt %, 3.0 wt % and 3.0 wt %, respectively, to make spinning solution D27. This spinning solution D27 was dry-spun and wound at a spinning speed of 600 m/minute with a speed ratio of the Godet roller and winder of 1.20, thereby producing 20 dtex monofilament polyurethane elastic yarn (500 g spool) in which the content of benzophenone-based ultraviolet light absorbent containing at least one sulfonic acid group in the molecule was 3 wt %.

The composition (wt %) of the obtained polyurethane elastic yarn was as shown in Table 7. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 8. Fracture strength and elongation were greater than in comparative example 2, which contained no benzophenone-based ultraviolet light absorbent containing at least one sulfonic acid group in the molecule, and comparative example 10 (described below), which contained benzophenone-based ultraviolet light absorbent that did not contain any sulfonic acid groups in the molecule. The values of permanent strain and stress relief were lower than in comparative example 2 and comparative example 10, and recovery characteristics were better. Durability against light radiation and durability against light radiation after immersion in organic solvent were more three times as high as in comparative example 2. Compared to comparative example 10, durability against light radiation before immersion in organic solvent was about 1.2 times higher, and durability after immersion in organic solvent was more than twice as high. Whiteness retention against light radiation and whiteness retention against light radiation after immersion in organic solvent were both greatly improved compared to comparative example 2, and whiteness retention was much better than in comparative example 10 after immersion in organic solvent.

Example 28

The polymer solution P2 prepared in example 3, the ultraviolet light absorbent solution A26 prepared in example 26 and the other additive solution B1 prepared in example 1 were homogenously mixed in amounts of 94.0 wt %, 3.0 wt % and 3.0 wt %, respectively, to make spinning solution D28. This spinning solution D28 was dry-spun and wound at a spinning speed of 600 m/minute with a speed ratio of the Godet roller and winder of 1.30, thereby producing 20 dtex two-filament multifilament polyurethane elastic yarn {500 g spool) in which the content of benzophenone-based ultraviolet light absorbent containing at least one sulfonic acid group in the molecule was 3 wt %.

The composition (wt %) of the obtained polyurethane elastic yarn was as shown in Table 7. The fracture elongation, fracture strength, strength in region of actual use, permanent strain, stress relief durability against light radiation, whiteness retention against light radiation, durability against light radiation after immersion in organic solvent and whiteness retention against light radiation after immersion in organic solvent of this polyurethane elastic yarn are shown in Table 8. Fracture strength and elongation were greater than in comparative example 2, which contained no benzophenone-based ultraviolet light absorbent containing at least one sulfonic acid group in the molecule, and comparative example 10 (described below), which contained benzophenone-based ultraviolet light absorbent that did not contain any sulfonic acid groups in the molecule. The values of permanent strain and stress relief were lower than in comparative example 2 and comparative example 10, and recovery characteristics were better. Durability against light radiation and durability against light radiation after immersion in organic solvent were more than twice as high as in comparative example 2.

Compared to comparative example 10, durability against light radiation before immersion in organic solvent was 1.2 times higher, but durability after immersion in organic solvent was more than twice as high as in comparative example 10. Whiteness retention against light radiation and whiteness retention against light radiation after immersion in organic solvent were both greatly improved compared to comparative example 2, and whiteness retention was much better than in comparative example 10 after immersion in organic solvent.

Example 29

The polymer solution P2 prepared in example 3, the ultraviolet light absorbent solution A26 prepared in example 26 and the other additive solution B1 prepared in example 1 were homogenously mixed in amounts of 96.7 wt %, 0.3 wt % and 3.0 wt %, respectively, to make spinning solution D29.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 7. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 8. Fracture strength and elongation were greater than in comparative example 2, which contained no benzophenone-based ultraviolet light absorbent containing at least one sulfonic acid group in the molecule, and comparative example 10 (described below), which contained benzophenone-based ultraviolet light absorbent that did not contain any sulfonic acid groups in the molecule. The values of permanent strain and stress relief were lower than in comparative example 2 and comparative example 10, and recovery characteristics were better. Durability against light radiation and durability against light radiation after immersion in organic solvent were more than twice as high as in comparative example 2. Compared to comparative example 10, durability against light radiation before immersion in organic solvent was about the same, but durability after immersion in organic solvent was about 1.8 times higher. Whiteness retention against light radiation and whiteness retention against light radiation after immersion in organic solvent were both greatly improved compared to comparative example 2, and whiteness retention was much better than in comparative example 10 after immersion in organic solvent.

Example 30

The polymer solution P2 prepared in example 3, the ultraviolet light absorbent solution A26 prepared in example 26 and the other additive solution B1 prepared in example 1 were homogenously mixed in amounts of 96.3 wt %, 0.7 wt % and 3.0 wt %, respectively, to make spinning solution 030.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 7. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 8. Fracture strength and elongation were greater than in comparative example 2, which contained no benzophenone-based ultraviolet light absorbent containing at least one sulfonic acid group in the molecule, and comparative example 10 (described below), which contained benzophenone-based ultraviolet light absorbent that did not contain any sulfonic acid groups in the molecule. The values of permanent strain and stress relief were lower than in comparative example 2 and comparative example 10, and recovery characteristics were better. Durability against light radiation and durability against light radiation after immersion in organic solvent were more than twice as high as in comparative example 2. Compared to comparative example 10, durability against light radiation before immersion in organic solvent was about the same, but durability after immersion in organic solvent more than twice as high. Whiteness retention against light radiation and whiteness retention against light radiation after immersion in organic solvent were both greatly improved compared to comparative example 2, and whiteness retention was much better than in comparative example 10 after immersion in organic solvent.

Example 31

The polymer solution P2 prepared in example 3, the ultraviolet light absorbent solution A26 prepared in example 26 and the other additive solution B1 prepared in example were homogenously mixed in amounts of 84.0 wt %, 13.0 wt % and 3.0 wt %, respectively, to make spinning solution D31.

This spinning solution was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 7. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 8. Fracture strength and elongation were greater than in comparative example 2, which contained no benzophenone-based ultraviolet light absorbent containing at least one sulfonic acid group in the molecule, and comparative example 10 (described below), which contained benzophenone-based ultraviolet light absorbent that did not contain any sulfonic acid groups in the molecule. The values of permanent strain and stress relief were lower than in comparative example 2 and comparative example 10, and recovery characteristics were better. Durability against light radiation and durability against light radiation after immersion in organic solvent were more than three times as high as in comparative example 2. Compared to comparative example 10, durability against light radiation before immersion in organic solvent was about 1.2 times higher, but durability after immersion in organic solvent more than twice as high. Whiteness retention against light radiation and whiteness retention against light radiation after immersion in organic solvent were both greatly improved compared to comparative example 2, and whiteness retention was much better than in comparative example 10 after immersion in organic solvent.

Example 32

The polymer solution P2 prepared in example 3, the ultraviolet light absorbent solution A26 prepared in example 26 and the other additive solution B1 prepared in example were homogenously mixed in amounts of 80.0 wt %, 17.0 wt % and 3.0 wt %, respectively, to make spinning solution D32.

This spinning solution D32 was dry-spun and wound at a spinning speed of 600 m/minute with a speed ratio of the Godet roller and winder of 1.30, thereby producing 20 dtex two-filament multifilament polyurethane elastic yarn (500 g spool).

The composition (wt %) of the obtained polyurethane elastic yarn was as shown in Table 7. The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 8. Fracture strength and elongation were greater than in comparative example 2, which contained no benzophenone-based ultraviolet light absorbent containing at least one sulfonic acid group in the molecule, and comparative example 10 (described below which contained benzophenone-based ultraviolet light absorbent that did not contain any sulfonic acid groups in the molecule. The values of permanent strain and stress relief were lower than in comparative example 2 and comparative example 10, and recovery characteristics were better.

Durability against light radiation after immersion in organic solvent was more than three times as high as in comparative example 2. Compared to comparative example 10, durability against light radiation before immersion in organic solvent was about 1.3 times higher, and durability after immersion in organic solvent more than twice as high. Whiteness retention against light radiation and whiteness retention against light radiation after immersion in organic solvent were both greatly improved compared to comparative example 2, and whiteness retention was much better than in comparative example 10 after immersion in organic solvent.

Comparative Example 9

A DMAc solution C9 (35 wt %) of octabenzone, which is a benzophenone-based ultraviolet light absorbent that does not contain any sulfonic acid groups in the molecule, was prepared.

The polymer solution P1 prepared in example 1, the aforementioned ultraviolet light absorbent solution C9 and the other additive solution B1 prepared in example were homogenously mixed in amounts of 94 wt %, 3.0 wt % and 3.0 wt %, respectively, to make spinning solution E7. This spinning solution E7 was dry-spun and wound at a spinning speed of 540 m/minute with a speed ratio of the Godet roller and winder of 1.4, thereby producing 20 dtex monofilament polyurethane elastic yarn (200 g spool).

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 8.

Comparative Example 10

The polymer solution P2 prepared in example 3, the ultraviolet light absorbent solution C9 prepared in comparative example 9 and the other additive solution B1 prepared in example 1 were homogenously mixed in amounts of 94 wt %, 3.0 wt % and 3.0 wt %, respectively, to make spinning solution E10. This spinning solution E10 was dry-spun and wound at a spinning speed of 600 m/minute with a speed ratio of the Godet roller and winder of 1.30, thereby producing 20 dtex two-filament multifilament polyurethane elastic yarn (500 g spool).

The fracture elongation, fracture strength, strength in region of actual use, permanent strain, stress relief, durability against light radiation, whiteness retention against light radiation, durability against light radiation after immersion in organic solvent and whiteness retention against light radiation after immersion in organic solvent of this polyurethane elastic yarn are shown in Table 8.

TABLE 7

| | Base polymer | | Benzophenone-based UV absorbent containing at least one sulfonic acid group bond in molecule | | Other additives | | Benzophenone-based UV absorbent containing no sulfonic acid groups in molecule | |
|---|---|---|---|---|---|---|---|---|
| | (p1) Polyurethane polymer made up of PTMG, MDI, EG | (p2) Polyurethane urea polymer made up of PTMG, MDI, EDA | (C-1) 2,4-dihydroxy-benzophenone-sulfonic acid | (C-2) 2-hydroxy-4-methoxy-benzophenone-5-sulfonic acid | (b1) Polyurethane produced by reaction oft-butyldiethanolamine and methylene-bis-(4-cyclohexyl isocyanate) | (b2) Condensed polymer of p-cresol and divinylbenzene | (c1) Octabenzone, Chimassorb ® 81 | Total contained components (wt %) |
| Ex. 25 | 94 | 0 | 3 | 0 | 2 | 1 | 0 | 100 |
| Ex. 26 | 94 | 0 | 0 | 3 | 2 | 1 | 0 | 100 |
| Ex. 27 | 0 | 94 | 3 | 0 | 2 | 1 | 0 | 100 |
| Ex. 28 | 0 | 94 | 0 | 3 | 2 | 1 | 0 | 100 |
| Ex. 29 | o | 96.7 | 0 | 0.3 | 2 | 1 | 0 | 100 |
| Ex. 30 | 0 | 96.3 | 0 | 0.7 | 2 | 1 | 0 | 100 |
| Ex. 31 | 0 | 84 | 0 | 13 | 2 | 1 | 0 | 100 |
| Ex. 32 | 0 | 80 | 0 | 17 | 2 | 1 | 0 | 100 |

TABLE 7-continued

| | Base polymer | | Benzophenone-based UV absorbent containing at least one sulfonic acid group bond in molecule | | Other additives | | Benzophenone-based UV absorbent containing no sulfonic acid groups in molecule | |
|---|---|---|---|---|---|---|---|---|
| | (p1) Polyurethane polymer made up of PTMG, MDI, EG | (p2) Polyurethane urea polymer made up of PTMG, MDI, EDA | (C-1) 2,4-dihydroxy-benzophenone-sulfonic acid | (C-2) 2-hydroxy-4-methoxy-benzophenone-5-sulfonic acid | (b1) Polyurethane produced by reaction oft-butyldiethanolamine and methylene-bis-(4-cyclohexyl isocyanate) | (b2) Condensed polymer of p-cresol and divinylbenzene | (c1) Octabenzone, Chimassorb ® 81 | Total contained components (wt %) |
| Comp. ex. 1 | 97 | 0 | 0 | 0 | 2 | 1 | 0 | 100 |
| Comp. ex. 2 | 0 | 97 | 0 | 0 | 2 | 1 | 0 | 100 |
| Comp. ex. 9 | 94 | 0 | 0 | 0 | 2 | 1 | 3 | 100 |
| Comp. ex. 10 | 0 | 94 | 0. | 0 | 2 | 1 | 3 | 100 |

TABLE 8

| | Characteristics of polyurethane elastic yarn | | | | | | | | |
|---|---|---|---|---|---|---|---|---|---|
| | | | | | Strength in | | | After immersion in organic solvent | |
| | Fracture elongation (%) | Fracture strength (eN) | Permanent strain (%) | Stress relief (%) | region of actual use (eN) | Durability against light radiation (%) | Whiteness retention against light radiation | Durability against light radiation (%) | Whiteness retention against light radiation |
| Ex. 25 | 430 | 23 | 22 | 31 | 0.68 | 77 | Excellent | 76 | Excellent |
| Ex. 26 | 445 | 25 | 21 | 30 | 0.75 | 81 | Excellent | 80 | Excellent |
| Ex. 27 | 580 | 33 | 15 | 26 | 0.72 | 93 | Excellent | 92 | Excellent |
| Ex. 28 | 605 | 35 | 13 | 25 | 0.79 | 90 | Excellent | 91 | Excellent |
| Ex. 29 | 530 | 30 | 15 | 27 | 0.71 | 77 | Excellent | 69 | Excellent |
| Ex. 30 | 535 | 31 | 14 | 25 | 0.70 | 80 | Excellent | 79 | Excellent |
| Ex. 31 | 560 | 30 | 16 | 26 | 0.70 | 92 | Excellent | 93 | Excellent |
| Ex. 32 | 525 | 28 | 16 | 25 | 0.63 | 94 | Excellent | 93 | Excellent |
| Comp. ex. 1 | 387 | 20 | 27 | 37 | 0.55 | 36 | Poor | 31 | Poor |
| Comp. ex. 2 | 490 | 25 | 18 | 28 | 0.50 | 30 | Fair | 29 | Poor |
| Comp. ex. 9 | 380 | 21 | 25 | 38 | 0.55 | 78 | Excellent | 33 | Fair |
| Comp. ex. 10 | 495 | 24 | 19 | 28 | 0.49 | 75 | Good | 39 | Poor |

INDUSTRIAL APPLICABILITY

The polyurethane elastic yarn of the present invention has high strength and elongation, high recovery characteristics and excellent resistance to light, and furthermore, can maintain excellent resistance to light without loss of ultraviolet light absorbent due to washing or post-treatment during high-level processing. Therefore, apparel and so forth that uses such elastic yarn is easy to put on and take off and has excellent fit, feel, discoloration characteristics and quality of appearance. Furthermore, the fineness of the polyurethane fiber can be reduced and fabric structure design with reduced content ratio is possible because strength in the region of actual use is high, and the apparel that uses this elastic yarn can be thin and light-weight because fabric stretch characteristics can be maintained at the same level as conventional fabrics even with a lower fabric density.

Due to having these excellent characteristics, the polyurethane elastic fiber of the present invention can, of course, be used independently, but can also be used to obtain excellent stretch fabrics in combination with various fibers, and is advantageously used in weaving, knitting and braiding. Specific applications in which it can be used include various textile products such as socks, stockings, circular knits, tricot, swimwear, ski pants, work clothes, golf pants, wet suits, brassieres, girdles and gloves, elastic materials, waterproof elastic materials of sanitary products such as paper diapers, elastic materials for waterproof materials, imitation bait, artificial flowers, electrical insulation materials, wiping cloth, copy cleaners, gaskets and the like.

The invention claimed is:

1. A method for producing a polyurethane elastic yarn, said method comprising:

polymerizing (i) a polymer diol and diisocyanate and a low molecular weight diamine, selected from the group consisting of ethylenediamine; 1,2-propanediamine; 1,3-propanediamine; hexamethylenediamine; p-phenylenediamine; p-xylylenediamine; m-xylylenediamine; p,p'-methylenediamine; 1,3-cyclohexyldiamine; hexahydrometaphenylenediamine; 2-methylpentamethylenediamine; and bis(4-aminophenyl)phosphine oxide, or (ii) a polymer diol and diisocyanate and a low molecular weight diol, to prepare a polyurethane, and dissolving said polyurethane in a solvent to prepare a polymer solution;

separately dissolving at least one additive selected from (A), (B) and (C) below in a solvent to prepare an additive-containing solution:

(A) a benzotriazole-based ultraviolet light absorbent comprising 2-(2'-hydroxy-5'-methacryloxymethylphenyl)-2H-benzotriazole of Formula 3:

Formula 3

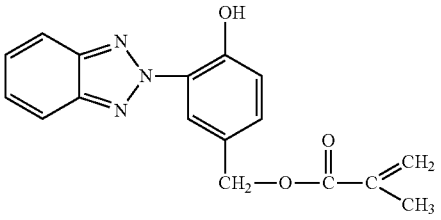

and/or benzophenone-based ultraviolet light absorbent containing at least one unsaturated bond in the molecule according to Formula 4 wherein R(A') is a monovalent organic group containing the at least one unsaturated bond:

Formula 4

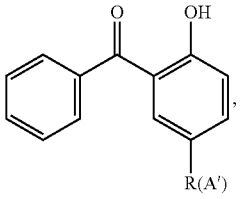

(B) a benzotriazole-based ultraviolet light absorbent containing at least one alkoxy group in the molecule according to Formula 6:

Formula 6

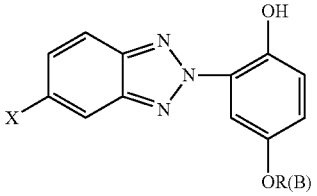

wherein R(B) is a monovalent organic group and X is a monovalent organic group or a halogen atom, and (C) a benzophenone-based ultraviolet light absorbent containing at least one sulfonic acid group in the molecule according to Formula 7 wherein R(C) is a monovalent organic group:

Formula 7'

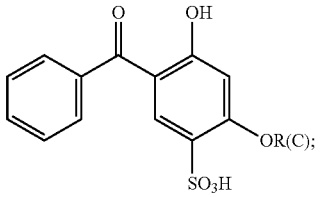

adding to said polymer solution said additive-containing solution to prepare a spinning solution; and spinning said spinning solution to produce the desired polyurethane elastic yarn, wherein said at least one additive is present in the range of about 0.5 wt % to about 15 wt % with respect to the total weight of the polyurethane elastic yarn.

2. The method of claim 1, wherein said additive is A.

3. The method of claim 1, wherein said additive is B.

4. The method of claim 1, wherein said additive is C.

5. The method of claim 1, wherein said additive is a mixture of A and B.

6. The method of claim 1, wherein said additive is a mixture of A and C.

7. The method of claim 1, wherein said additive is a mixture of C and B.

8. A polyurethane elastic yarn prepared by the method of claim 1.

9. A polyurethane elastic yarn prepared by the method of claim 2.

10. A polyurethane elastic yarn prepared by the method of claim 3.

11. A polyurethane elastic yarn prepared by the method of claim 4.

12. A polyurethane elastic yarn prepared by the method of claim 5.

13. A polyurethane elastic yarn prepared by the method of claim 6.

14. A polyurethane elastic yarn prepared by the method of claim 7.

15. The method of claim 1, wherein the polymerizing step comprises polymerizing a polymer diol and diisocyanate and a low molecular weight diol.

16. The method of claim 1, wherein the low molecular weight diamine is selected from the group consisting of 1,2-propanediamine; 1,3-propanediamine; hexamethylenediamine; p-phenylenediamine; m-xylylenediamine; p-xylylenediamine; p,p'-methylenediamine; 1,3-cyclohexyldiamine; hexahydrometaphenylenediamine; 2-methylpentamethylenediamine and bis(4-aminophenyl) phosphine oxide.

17. The method of claim 1, wherein the low molecular weight diamine is selected from the group consisting of 1,2-propanediamine; 1,3-propanediamine; hexamethylenediamine; p-phenylenediamine; p-xylylenediamine; p,p'-methylenediamine; 1,3-cyclohexyldiamine; hexahydrometaphenylenediamine; 2-methylpentamethylenediamine; and bis(4-aminophenyl)phosphine oxide).

18. The method of claim 1, wherein the low molecular weight diamine is selected from the group consisting of 1,2-propanediamine and 1,3-propanediamine.

19. The method of claim 1, wherein the low molecular weight diamine is ethylenediamine.

20. The method of claim 1, wherein the low molecular weight diamine is selected from the group consisting of hexamethylenediamine; p-phenylenediamine; p,p'-methylenediamine; 1,3-cyclohexyldiamine; hexahydrometaphenylenediamine; 2-methylpentamethylenediamine; and bis(4-aminophenyl)phosphine oxide.

* * * * *